US011426888B1

(12) United States Patent
Mon

(10) Patent No.: US 11,426,888 B1
(45) Date of Patent: Aug. 30, 2022

(54) HANDHELD CUTTING TOOL

(71) Applicant: George Emmanuel Mon, Ladera Ranch, CA (US)

(72) Inventor: George Emmanuel Mon, Ladera Ranch, CA (US)

( * ) Notice: Subject to any disclaimer, the term of this patent is extended or adjusted under 35 U.S.C. 154(b) by 0 days.

(21) Appl. No.: 17/704,935

(22) Filed: Mar. 25, 2022

Related U.S. Application Data

(63) Continuation-in-part of application No. 17/567,319, filed on Jan. 3, 2022, now Pat. No. 11,326,632.

(51) Int. Cl.
*B26B 5/00* (2006.01)
*B25G 3/38* (2006.01)
*B25G 1/08* (2006.01)

(52) U.S. Cl.
CPC ..... *B26B 5/006* (2013.01); *B25G 1/08* (2013.01); *B25G 3/38* (2013.01)

(58) Field of Classification Search
CPC ..... B26B 5/006; B25G 1/08; B25G 3/38
See application file for complete search history.

(56) References Cited

U.S. PATENT DOCUMENTS 7,814,664 B2 * 10/2010 LeBlanc ..... B26B 1/042 30/330
9,943,970 B2 * 4/2018 Glesser ..... B26B 1/048
2009/0223061 A1 * 9/2009 Seber ..... B26B 1/048 30/160
2018/0354144 A1 * 12/2018 LeBlanc ..... B26B 1/04
2019/0308335 A1 * 10/2019 Korthuis ..... B26B 5/00
2020/0324423 A1 * 10/2020 Hurwicz ..... B26B 29/02
2021/0354318 A1 * 11/2021 Scimone ..... B26B 1/04

* cited by examiner

*Primary Examiner* — Omar Flores Sanchez

(57) ABSTRACT

Presented embodiments of the handheld cutting tool are capable of cutting in one of two ways: with the cutting edge of the blade only so as to minimize damage to objects not intended to be cut or, alternately, with the point of the blade as with more typical knives. The tool is comprised predominantly of a handle body, a blade holder and a rotational control assembly for allowing the blade holder to rotate. The blade holder holds either a replaceable isosceles trapezoid utility blade or replaceable single edge razor blade and has, in some embodiments, a portion that isolates parts of the blade from objects not intended to be cut. The rotational control assembly enables the blade holder to rotate between retracted and a plurality of extended positions thus permitting the blade holder to deploy the blade at various angles to facilitate proper cutting of materials.

20 Claims, 18 Drawing Sheets

FIG. 24
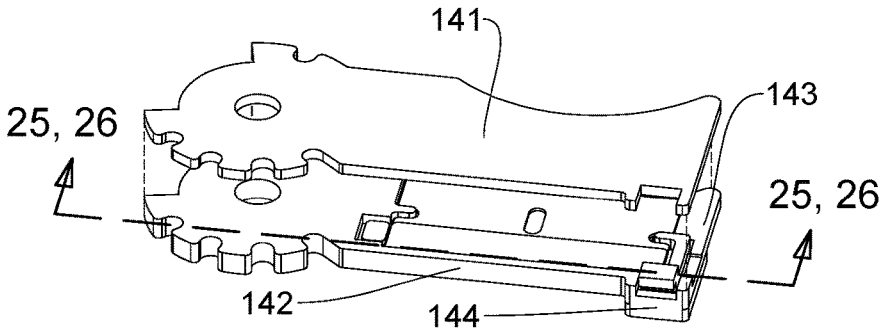
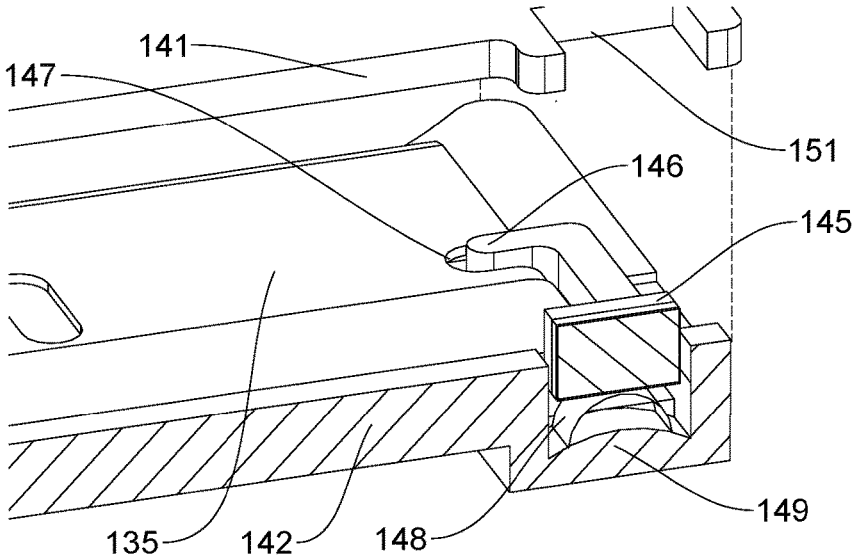
FIG. 25
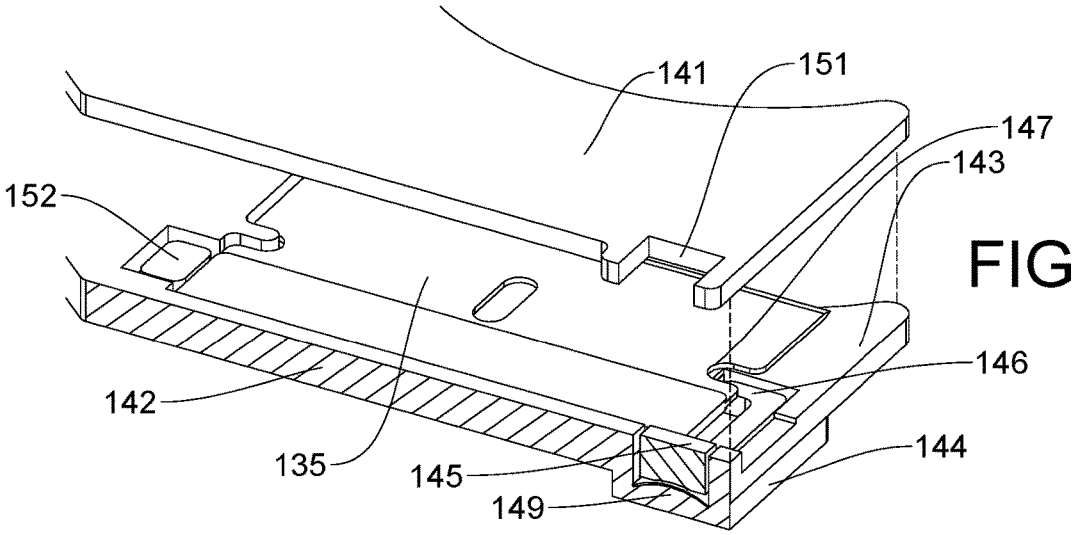
FIG. 26

HANDHELD CUTTING TOOL

CROSS REFERENCE TO RELATED PATENT APPLICATIONS

This application claims the benefit of U.S. Non-Provisional Utility Patent application Ser. No. 17/567,319 filed Jan. 3, 2022 by George E. Mon as sole inventor, the contents of which are incorporated herein by reference in its entirety. The Axially Aligned Coupling of application Ser. No. 17/567,319 is used as a non-limiting element of the presented cutting tool.

FIELD OF THE INVENTION

The present invention relates to handheld cutting implements with a replaceable blade.

BACKGROUND OF THE INVENTION

Handheld cutting tools such as utility type knives are generally designed to be portable cutting tools that use standard replaceable blades which may retract or may have blade holders that pivot into the tool handle so as to prevent inadvertent cutting and enable safe storage and transport. They have handles of sufficient length and of such a form as to be securely held by the user and have the blade at a reasonable distance from the hand for safer operation.

Typically, such handheld cutting tools cut with the blade edge oriented down and the point coming into direct contact with the object or materials to be cut. The user generally cuts by pulling the tool linearly towards themselves as when cutting sheet goods. Additionally, they can cut materials crosswise as when sectioning off a piece of rope or can cut in a circular manner when, for example, making a circular cut of electrical cable insulation for removal.

In any of these instances, the blade and point of the blade are capable of an undesired penetration through materials intended to be cut thus damaging objects which lie underneath and which are not intended to be cut.

Tools other than utility knives exist for addressing this cut through problem but all have non-replaceable blades of one form or another necessitating disposal of the entire tool when the blade becomes dull.

SUMMARY OF THE INVENTION

The presented device is a handheld cutting tool which deploys a standard replaceable blade and may be used to cut with the cutting edge of the blade by moving the tool in a direction generally away from the user. Certain tool embodiments permit cutting with the point of the blade as well as with the edge. The tool possesses two major improvements over prior art: a blade holder that, in some embodiments, promotes damage free cutting and a rotation control assembly that provides high resistance to rotational forces produced by knife use and, additionally, selective adjustability of blade cutting angle.

The blade is housed in a blade holder designed to not only deploy the blade, but also, in some embodiments, to help prevent damage to objects not intended to be cut. The blade holder has a specific shape formed to hold a replaceable blade and, optionally, a nosing at the distal end of the blade holder formed so as to isolate portions of the blade. Material not intended to be cut is insulated from the blade by this nosing.

Various blade holder embodiments are disclosed—each with the characteristics of the invention. Two factors determine the basic form of the blade holder: 1) whether only the blade cutting edge is exposed or, alternately, the blade cutting edge and a non-cutting edge portion of the blade are exposed and 2) the type of replaceable blade used.

The blade holder which exposes only the blade cutting edge, henceforth referred to as point protected, can only cut using the cutting edge of the blade. The blade holder with the blade cutting edge and non-cutting portion of the blade exposed, henceforth referred to as point open, can cut with both the blade cutting edge and, alternately, the blade point, as with more typical knives.

The point protected blade holder design permits, when used blade edge up and with motion generally away from the user, cutting planar materials without damaging materials not intended to be cut by virtue of isolating the materials to be cut from the point of the blade.

The point open blade holder, with proper user technique, can function as either a damage reducing cutting tool or a standard replaceable knife cutting tool. It should be noted that with the point open tool, cutting blade edge up and tool away from the user requires establishing a proper angle of the blade holder nosing relative to the material be to be cut so as to ensure that the blade holder nosing and not the blade point contacts the surface underneath the material intended to be cut.

Tool blade holder embodiments deploy either a standard isosceles trapezoid utility knife blade or a standard rectangular single edge razor blade, both being common, inexpensive and replaceable.

All blade holder versions rotate on an axis perpendicular to the blade thereby allowing for a retracted position within the tool handle body or one of a plurality of deployed positions selected by the user. Blade holder parts are formed with detents to permit engagement in any of these positions. A specifically designed blade holder rotation control assembly, actuated by a push button, allows the blade holder to rotate or, alternately, locks it in the retracted or any of the deployed positions.

Additionally, the blade holder possesses two mechanisms for blade management. A releasable blade restraint either restricts blade movement during tool use or, when actuated, allows blade release for replacement without disassembly of the tool. Secondarily, a blade ejector drives the blade out of the blade holder when required for blade change thus diminishing injury risk to the user.

The handle in some embodiments is presented as an assembly of a plurality of layer type portions together forming a body and serving to conjoin and control the various elements of the tool. Required performance parameters and cost considerations determine materials and methods of manufacture of these layers. These various layer type portions are aligned and constrained to function as one by couplings and fasteners which will be described in the Detailed Description.

The handle of the tool is given one or more of the following features. First, the handle is fashioned to facilitate comfortable and sure grasping. Various handle embodiments suit various employments and their presumed typical user. Larger handles with finger grips and ribbed sections for more demanding tasks and smaller contoured handles for less demanding tasks as non-limiting examples. Second, the handle provides a housing for the blade holder and its constituent mechanisms in the retracted position. Optionally, a recess in the handle body provides a compartment for spare blade storage. Because the tool handle body can vary, they are not limited to specific body or proportion. Greater adaptability for use in a variety of applications and with larger range of manufacturing materials and methods are thus attained by the tool design.

The improvements of the present invention are in addressing the limitations and deficiencies of prior art in the field of both utility knives and other small handheld cutting tools.

Specifically, the improvements are fivefold. First: the blade holder, in some embodiments, permits cutting of materials while minimizing damage to adjacent materials or objects not intended to be cut. Second: the tool blade holder and rotation control assembly permit the blade holder and thus the blade to be positioned at a plurality of angles to facilitate more ergonomic tool use and more appropriate blade angles for specific cutting tasks. Third: the tool blade holder and rotation control assembly provide for generally greater resistance to both torque and linear forces generated by tool use and thus provides greater tool safety and durability. Fourth: because some blade holder embodiments can cut by moving the tool away from user hands and body, utilization is safer. This is especially so for employment where the user may be in an awkward or unstable position and for uses where the user's non knife wielding hand is close to the material being cut. Fifth: in contrast to other upward cutting tools, the presented tool allows for use of standard replaceable blades for more effective cutting, blade replacement, and reversal of the blade for lower blade replacement costs. Additionally, the releasable blade restraint and blade ejector permit blade replacement without tool disassembly.

The following detailed description and appended drawings describe and illustrate various exemplary embodiments of the invention. Each demonstrates non-limiting examples of construction and use while possessing characteristics of the invention. The description and drawings are not intended to limit the scope of the invention in any manner and the methods disclosed are representative of non-limiting applications. With respect to the manufacturing and assembly methods, the presented materials and methods of fabrication and the steps and order of steps are exemplary in nature and therefore not necessary or critical. Other ways or components are also contemplated including but not limited to substituting materials of fabrication.

BRIEF DESCRIPTION OF THE DRAWINGS

FIG. 24 is a perspective view of razor blade/point protected blade holder defining sections 25 and 26; razor planar first part displaced.

FIG. 25 is a fragmental sectional perspective view of razor blade/point protected blade holder blade restraint in the locked position; razor planar first part displaced.

FIG. 26 is a fragmental sectional perspective view of razor blade/point protected blade holder blade restraint in the unlocked position; razor planar first part displaced.

DETAILED DESCRIPTION OF THE PREFERRED EMBODIMENTS

Figure 1:
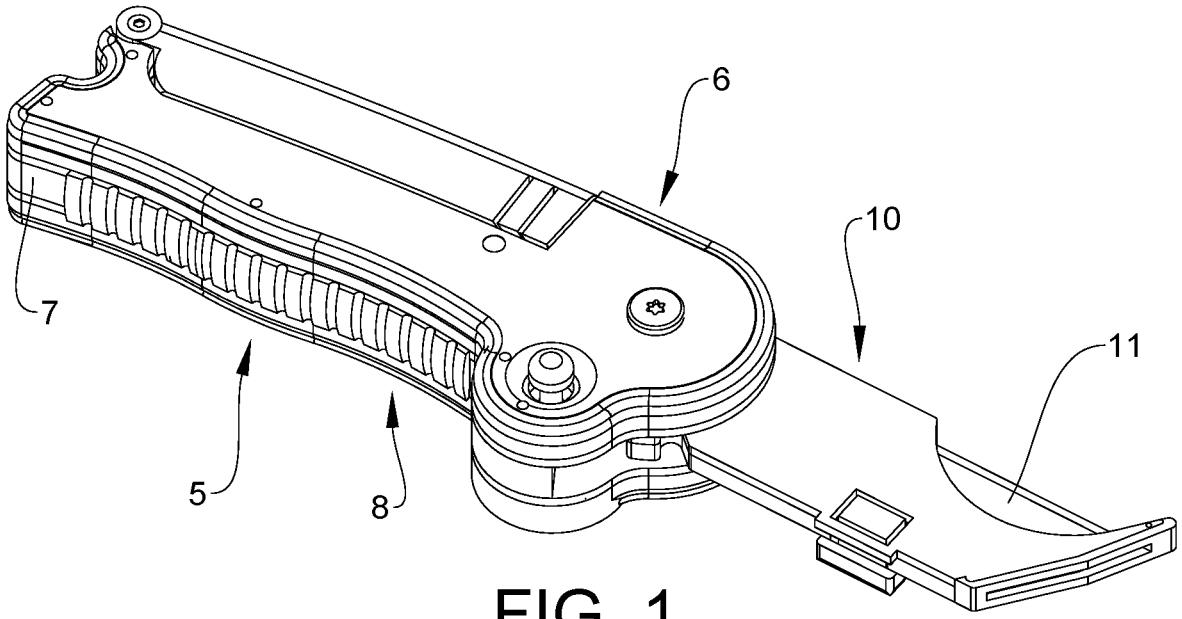
FIG. 1 is a perspective view of the utility blade/point protected cutting tool.
Figure 2:
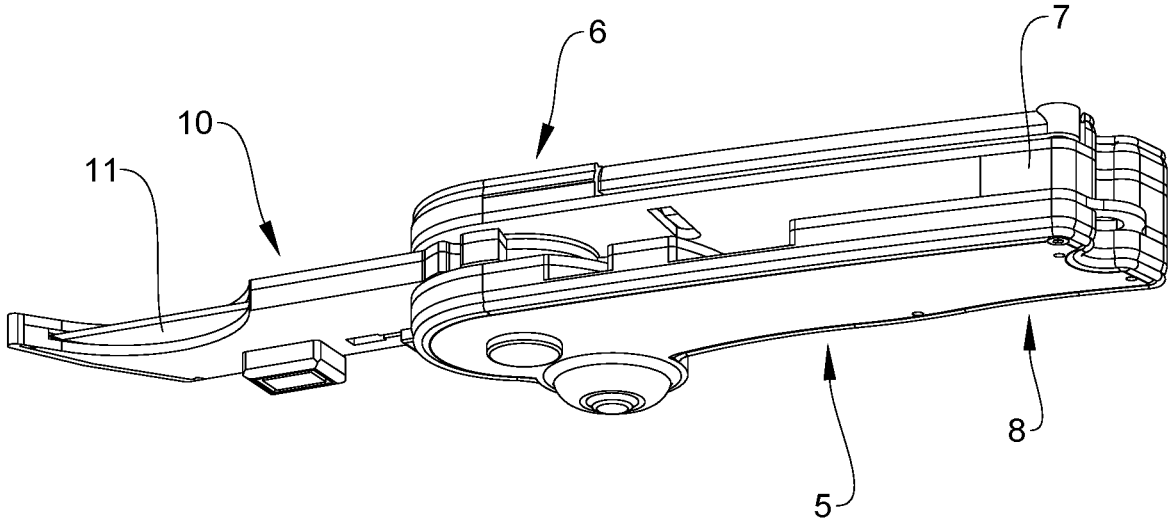
FIG. 2 is an alternate perspective view of the utility blade/point protected cutting tool.

Referring to FIGS. 1 and 2: the utility blade/point protected cutting tool presented is comprised of a utility handle body (5) and a utility blade/point protected blade holder (10). The utility handle body is further comprised of a utility body first half portion (6), utility body center portion (7) and utility body second half portion (8) which are placed together to form a structure to house and deploy a utility blade/point protected blade holder (10) and standard isosceles trapezoid utility blade (11).

Figure 3:
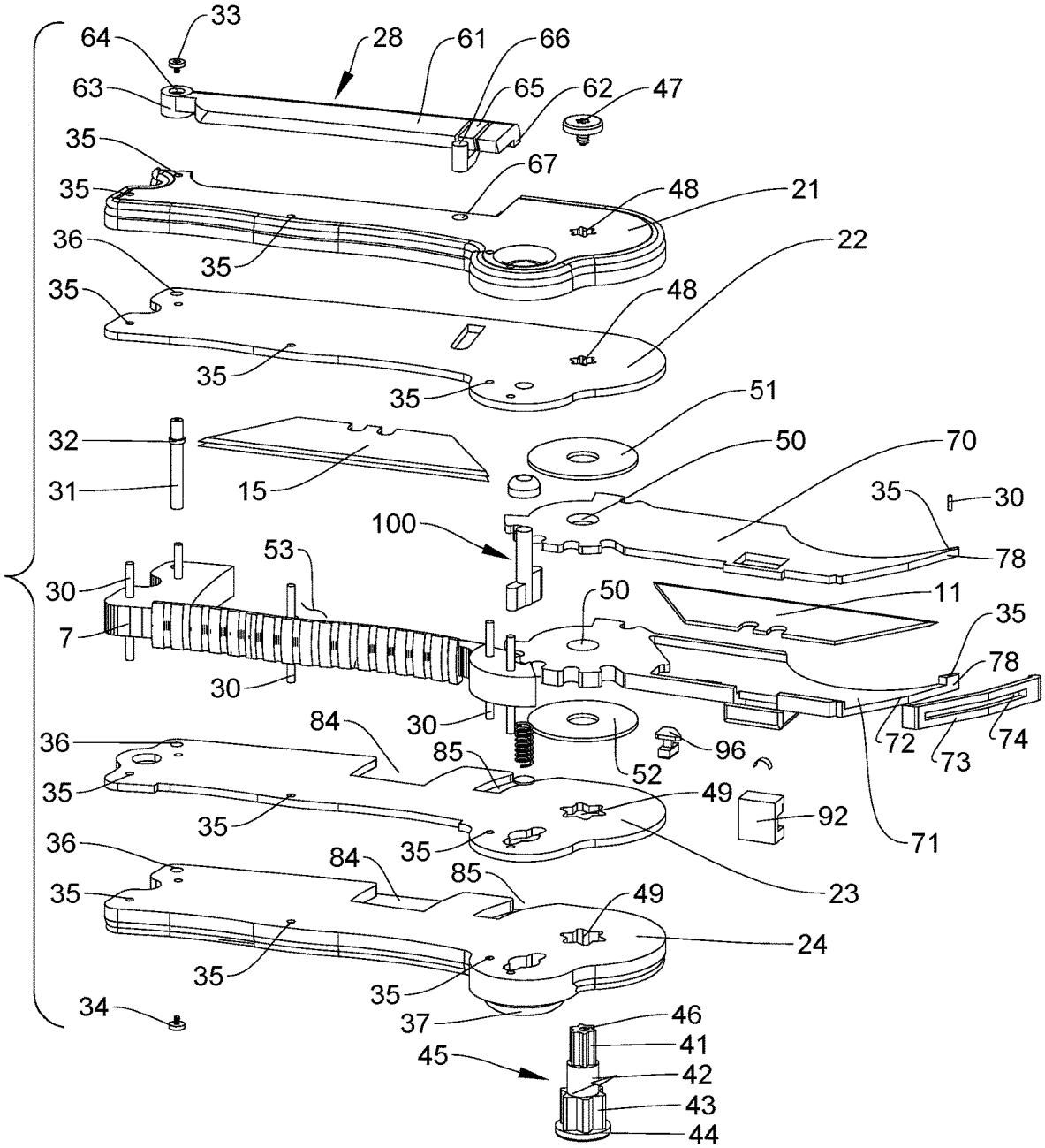
FIG. 3 is an exploded perspective view of the utility blade/point protected cutting tool.

Referring to FIG. 3: the utility handle body first half portion is comprised of a contoured outer layer (21) and a substantially-planar inner layer (22). Likewise, the utility handle body second half portion is comprised of a contoured outer layer (24) and a substantially-planar inner layer (23). The contoured outer layers (21, 24) are more complex shapes with filleted edges, recesses and indents. The substantially-planar inner layer portions (22, 23) ordinarily lack filleted edges and are formed from materials primarily selected for considerations of strength and flexural resistance. All layers have openings formed to allow for fastener and coupling use. The openings, recesses and indents placed in layers accommodate various tool elements that are discussed along with each element. Both contoured outer layers have radiused outside edges to provide a handle shape which promotes proper user holding. The first half contoured outer layer (21) is further modified to provide a recess for spare utility type blades (15) and for a spare blade compartment cover (28). The utility handle body center portion (7) placed between the first and second half portions is formed to provide a center recess for the blade holder in the retracted position. The body center portion (7) optionally provides a ribbed surface to facilitate a sure grip. These portions may be fabricated of materials as required for particular applications.

The utility handle body center portion and first and second half portion's constituent layers are aligned and constrained by a plurality of cylindrical fasteners (30) and two different couplings to form the handle body. The cylindrical fasteners (30) are placed at any point of manufacture and may be joined to and serve to join any or all layers using an adhesive bond as a non-limiting example. All layers have openings (35) to receive these cylindrical fasteners. The fasteners are shown in FIG. 3 inserted into provided body center portion openings and may vary in length as required by handle body proportions. The number of cylindrical fasteners and thus openings may vary; they are not all referenced in the drawings for visual clarity. The distal handle body area, that is the area away from the blade holder, is constrained by a two-sided flanged coupling (31) that possesses threaded recesses at both ends, an integrally connected flange (32) and threaded fasteners (33, 34) at either end of the flanged coupling. The coupling is placed through openings (36) in all layers except first half contoured outer layer (21) and must be inserted after all layers are placed from a specific inner layer (22) side. The coupling portion between the flange (32) and threaded fastener (34) serves to join and constrain all layers except the first half portion contoured outer layer. The flanged coupling portion between the flange (32) and threaded fastener (33) serves to attach the spare blade compartment cover (28) while allowing for its rotation and thus access to the compartment. The outer layer element (24) and spare blade compartment cover (28) are given cylindrical recesses to accommodate the threaded fasteners (33, 34).

The spare blade compartment cover (28) has a generally planar portion (61) and an integrally connected orthogonal portion (62) perpendicular to the planar portion (61) and are both shaped so as to align with the form of the utility handle body first half portion contoured outer layer (21) adjacent to it. The planar portion (61) and the outer layer (21) are shaped so as to provide space to accommodate spare blades (15). The blade compartment cover portion in line with the longitudinal axis of the two-sided flanged coupling (31) has a recess (64) which penetrates the cover to receive the coupling (31) and a cylindrical recess at its surface to accommodate the threaded fastener (33). The spare blade compartment cover thus can rotate about the longitudinal axis of the two-sided flanged coupling to an angle which permits access to the spare blades. Additionally, the spare blade compartment cover has a locking mechanism consisting of a flat rectangular portion (65) separated from the cover body except where it is joined to the perpendicular portion (62), a cylindrical portion (66) to align with and be constrained by a matching hole (67) in the layer element (21) when the cover is closed and locked. Depressing the flat rectangular portion (65) at a point away from where it is joined to the perpendicular portion (62) disengages the cylindrical portion (66) from the outer layer hole (67) permitting release of the lock and rotation of the cover. The spare blade compartment cover should be fabricated of a sufficiently pliant yet ductile material to permit this locking mechanism to function properly.

The handle body and its constituents and the blade holder are operably connected by a coupling. As a non-limiting example, an axially aligned coupling is presented with these cutting tool embodiments. This axially aligned coupling is the subject of a non-provisional patent application Ser. No. 17/567,319 submitted by the same sole inventor as this application. The use of the axially aligned coupling improves the operation and assembly of the cutting tool embodiments presented here, but the axially aligned coupling is not essential to the operation of the presented cutting tools.

Referring to FIG. 3: the axially aligned coupling body (45) has the following characteristics and constraints. The coupling has a longitudinal center axis along which portions whose normal section plane shape varies as required by their function. The first (41) and second (43) portions of the coupling are designed to have peripheral assembly components adjacent to them where no movement or rotation is desired. As such, a complex, non-circular shape for this coupling section is required. The shapes that achieve this result most effectively are generally but not exclusively complex, concave polygons. For the center portion (42), the coupling is shaped as a cylinder so as to allow adjacent components to rotate about the coupling center axis.

The various axially aligned coupling portion shapes are matched with radially adjacent components containing an opening whose shape is the negative of the adjacent coupling portion in section. This arrangement serves to provide forces opposing rotation of the assembly parts about the coupling axis first (41) and second (43) portions. The coupling portions provide forces directly opposing the assembly components openings minimizing slippage, disengagement or grinding type failures. For layer portions (21, 22) adjacent to axially aligned first portion (41) after tool assembly, the layer openings (48) substantially match the first coupling portion (41) shape. For layer portions (23, 24) adjacent to axially aligned second portion (43) after tool assembly, the layer openings (49) substantially match the second coupling portion (43) shape. The blade holder constituents (70, 71) are given a circular opening (50) of the same approximate diameter as the coupling center section (42) so as to allow the blade holder to rotate. The axially aligned coupling has a cylindrical end cap (44) integrally connected to the coupling second portion (43) and an internally threaded recess (46) at the opposite end to receive an externally threaded fastener (47). Recesses in the body outer layers (21, 24) to accommodate the cylinder end cap (44) and fastener (47) may be provided.

The axially aligned coupling can be placed from the handle body second half contoured outer layer (24) side after all layer portions, blade holder and friction washers (51, 52) are aligned, serially placed and conjoined whereupon the externally threaded fastener (47) is placed in the internally threaded recess (46). The axially aligned coupling now constrains the handle body constituent layers together, permits blade holder assembly rotation and thus operationally connects the blade holder to the handle body.

Referring to FIG. 3: the utility blade/point protected blade holder assembly is comprised of a point protected substantially-planar first part (70) and a point protected recessed second part (71) which possesses a recess in the approximate shape of a standard isosceles trapezoid utility blade. The depth of this recess should be selected so as to prohibit excessive movement of the blade orthogonal to its thin dimension. The point protected recessed second part (71) recess is substantially open on the distal non parallel side of the blade (72) and partially open to the side where the cutting edge of the blade occurs. When the both blade holder parts (70, 71) are joined, the utility blade is constrained except as to allow movement (extraction) linearly towards where the recessed second part is open (72). Other parts of the blade holder which control blade movement will be described later in this section. The point protected substantially-planar first part (70) can optionally be fabricated of materials to provide strength and rigidity and the recessed second part (71) of materials selected for ease of manufacturing considerations as non-limiting examples. The utility blade/point protected blade holder also optionally comprises a reinforcing piece (73) with crescent shaped ends to enclose portions of the blade holder first and second parts (70, 71) and thus stiffen the entire assembly. In addition, this reinforcing piece serves to further define the shape of the nosing and isolate the blade point from materials to be cut. The reinforcing piece (73) possesses a center opening (74) substantially aligning with that of the recessed second part to allow blade extraction. A cylindrical pin fastener (30) may be inserted into openings (35) in both blade holder parts at their nosings (78) to further strengthen and constrain the assembly. As previously described, this blade holder design permits, when used blade edge up and with motion generally away from the user, cutting planar materials with the blade edge avoiding damaging materials not intended to be cut by virtue of isolating the materials to be cut from the point of the blade.

Additional aspects of the cutting tool and blade holder, an assembly to control blade holder rotation and other blade management mechanisms will be described further in this detailed description section.

Figure 4:
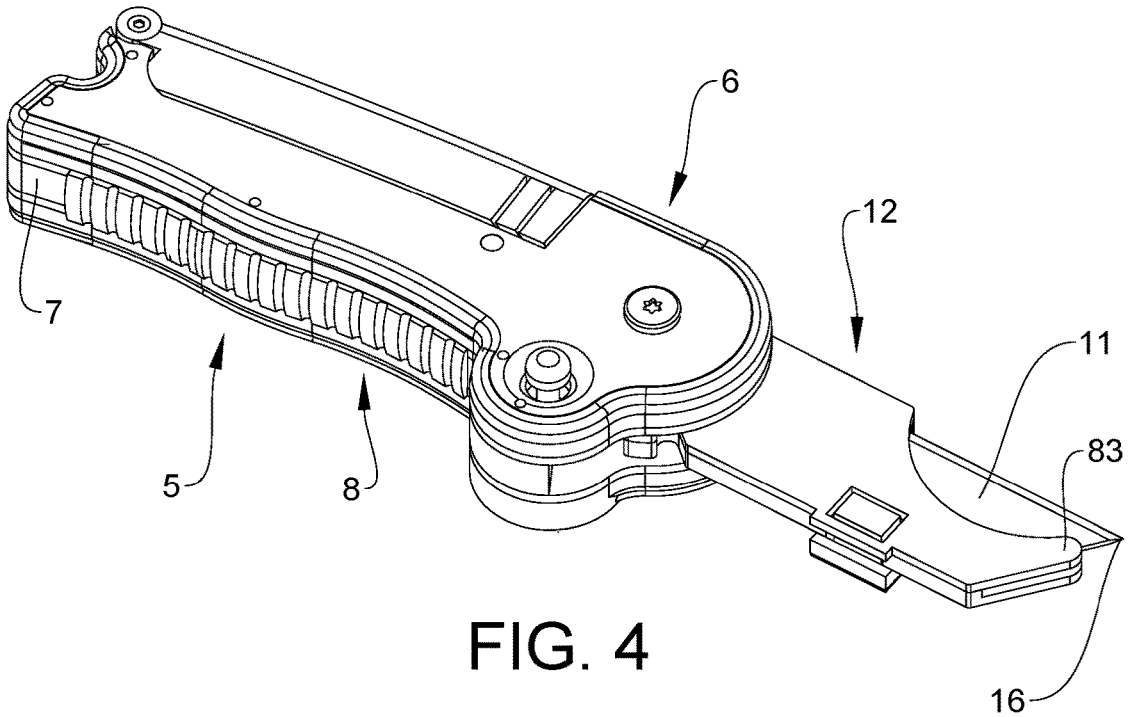
FIG. 4 is a perspective view of the utility blade/point open cutting tool.
Figure 5:
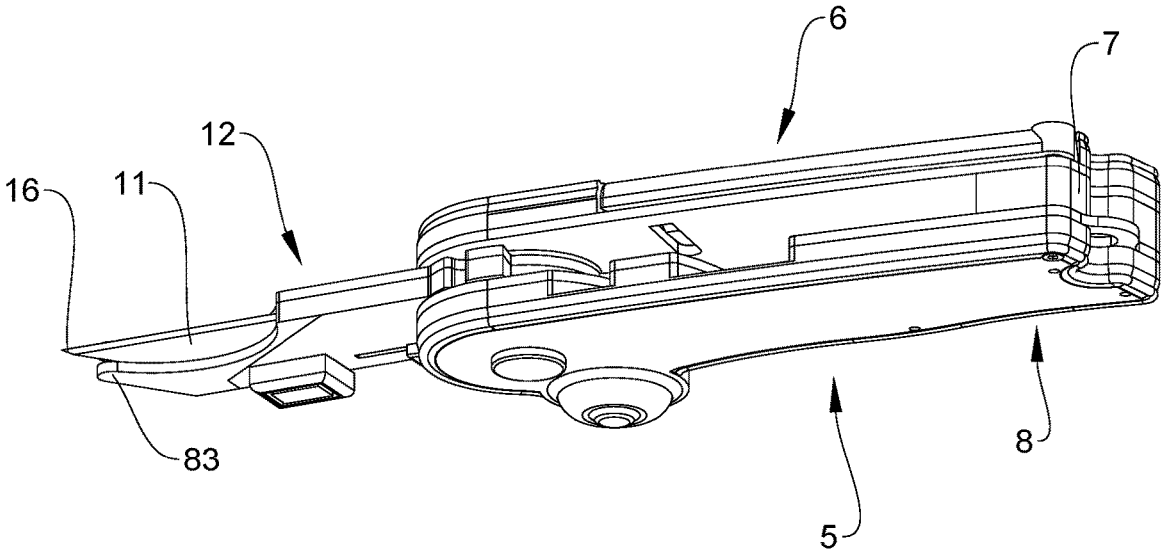
FIG. 5 is an alternate perspective view utility blade/point open cutting tool.
Figure 6:
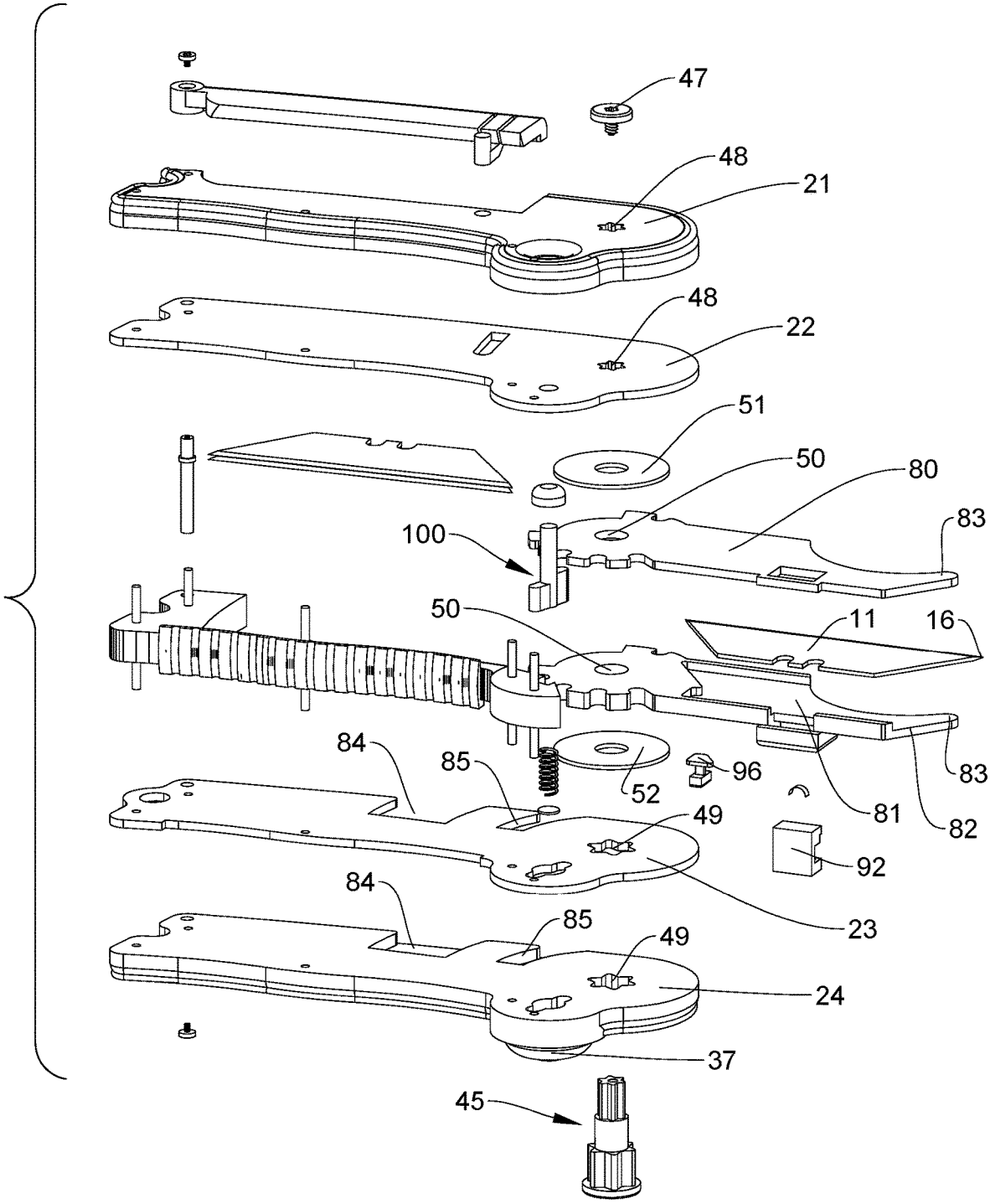
FIG. 6 is an exploded perspective view of the utility blade/point open cutting tool.

Referring to FIGS. 4, 5 and 6: the utility blade/point open embodiment of the cutting tool presented comprises a utility handle body (5) and a utility blade/point open blade holder (12). The handle body, use of fasteners and couplings are in all respects identical to the utility blade/point protected embodiment cutting tool and their description will not be repeated. Only portions related to the point open blade holder will be described and referenced in the drawings. The utility blade/point open blade holder (12) differs from the point protected in that both the substantially-planar first part and the recessed second part distal portions (83) closest to the blade point (16) are modified exposing a non-cutting edge portion of the utility blade (11). This feature allows for the user to cut blade edge up/away from the user as with the point protected tool previously described and, additionally, blade down with the point of the tool as with typical utility knives. It should be noted that cutting blade edge up/away from the user requires establishing a proper angle of the blade relative to the material be to be cut so as to ensure that the blade holder nosing and not the blade point contacts the material to be cut.

Referring to FIG. 6: The utility blade/point open embodiment blade holder is comprised of a point open substantially-planar first part (80) and a point open recessed second part (81) which possesses a recess in the approximate shape of a standard utility blade on two sides and portions of two sides. The point open recessed second part (81) recess is substantially open on the distal non parallel side of the blade (82) and partially open to the side aligned with the cutting edge of the blade.

When both point open blade holder parts are joined, the utility blade holder constrains the blade except as to allow movement (extraction) linearly towards where the second part recess is open (82). The point open planar first part (80) can be fabricated of materials to provide strength and rigidity and the point open recessed second part (81) of materials selected for ease of manufacturing considerations as non-limiting examples.

Referring to FIGS. 7-11: both the utility blade/point protected and utility blade/point open blade holders each possess two mechanisms for blade management. An operable utility blade restraint either restricts blade movement during tool use or, when actuated, allows blade release for replacement without disassembly of the tool. Secondarily, a utility blade ejector drives the blade out of the utility blade holder when required for blade change thus diminishing injury risk to the user. These mechanisms are described using the utility/point protected blade holder as representative of both point/protected and point/open blade holder types as the mechanisms for both are identical.

Figure 10:
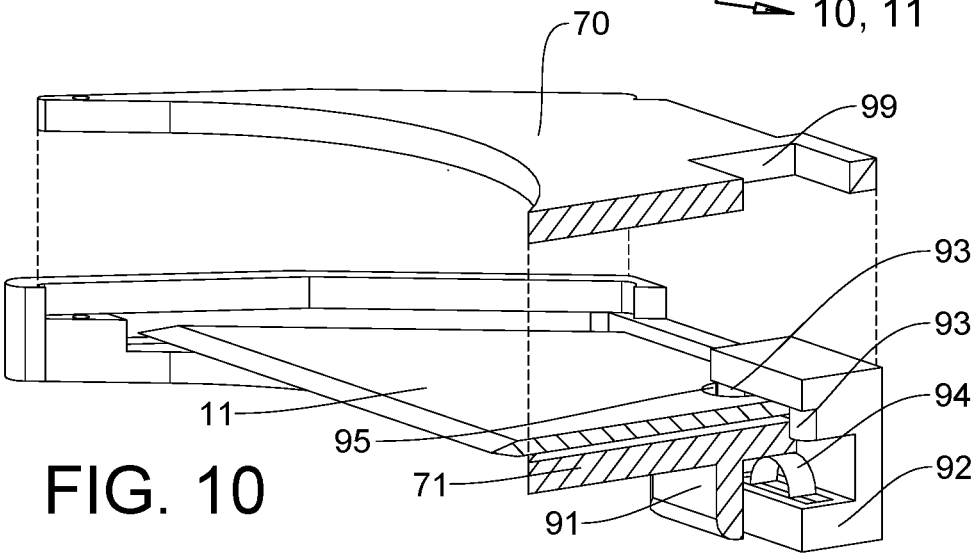
FIG. 10 is a fragmental sectional perspective view of utility blade/point protected blade holder blade restraint in the locked position; utility planar first part is displaced for visual clarity.
Figure 11:
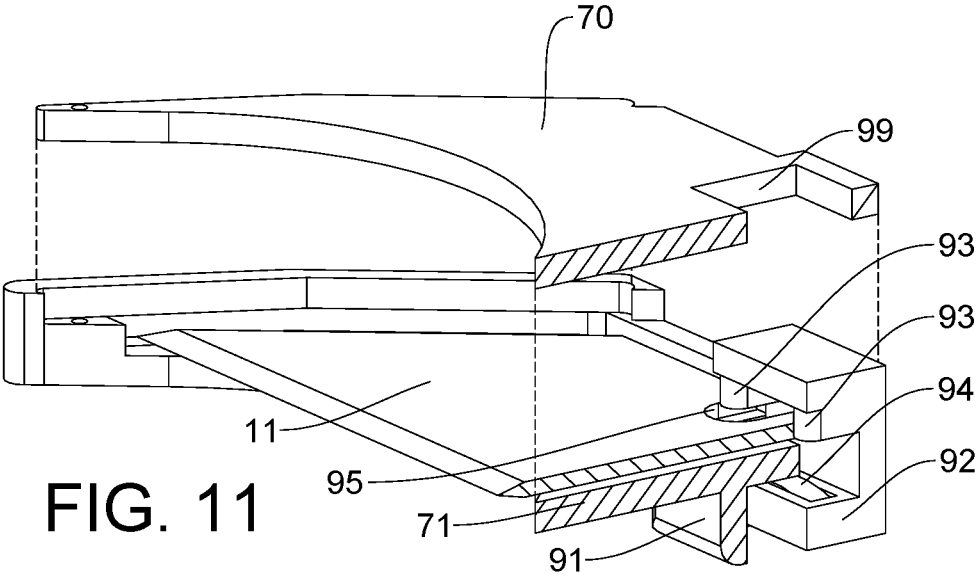
FIG. 11 is a fragmental sectional perspective view of utility blade/point protected blade holder blade restraint in the unlocked position; utility planar first part is displaced for visual clarity.

The utility blade restraint is comprised of a recess and housing portion (91) of the blade holder recessed second part, a utility blade engagement block (92) with projections (93) which engage with the utility blade center detents (95) when the restraint is in the unactuated position as shown in FIG. 10. Note the planar first part (70) is displaced and blade and blade holder parts are sectioned while the engagement block (92) is not sectioned in FIGS. 10 and 11 to provide visual clarity. As shown in FIG. 10, a semi-circular or arc leaf type spring (94) provides a resistive force to keep the engagement block in this position and the two blade holder parts (70, 71), when joined, constrain the block (92) in the unactuated position. When a force is applied to the recessed second part side of the engagement block by the user, the spring compresses and the ends move outwards allowing the engagement block to move to the blade release position as shown in FIG. 11. In this configuration the block projections (93) are not aligned with the blade detents (95) permitting the blade to be extracted. A recess (99) in the planar first part (70) also constrains the block (92), allowing only movement in the direction of actuation.

Figure 7:
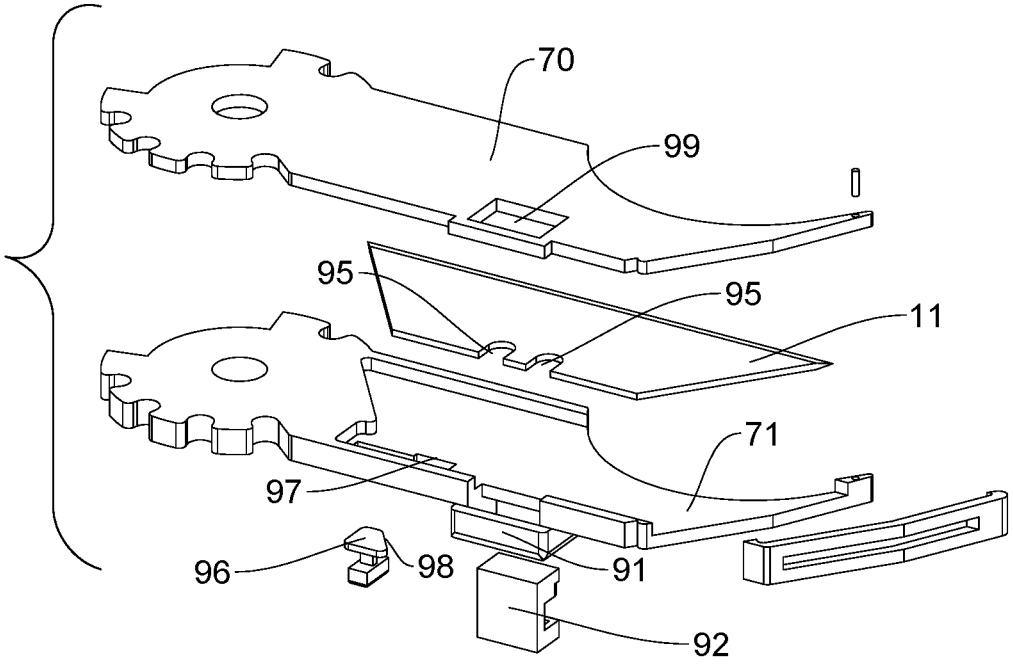
FIG. 7 is an exploded perspective view of the utility blade/point protected blade holder.
Figure 8:
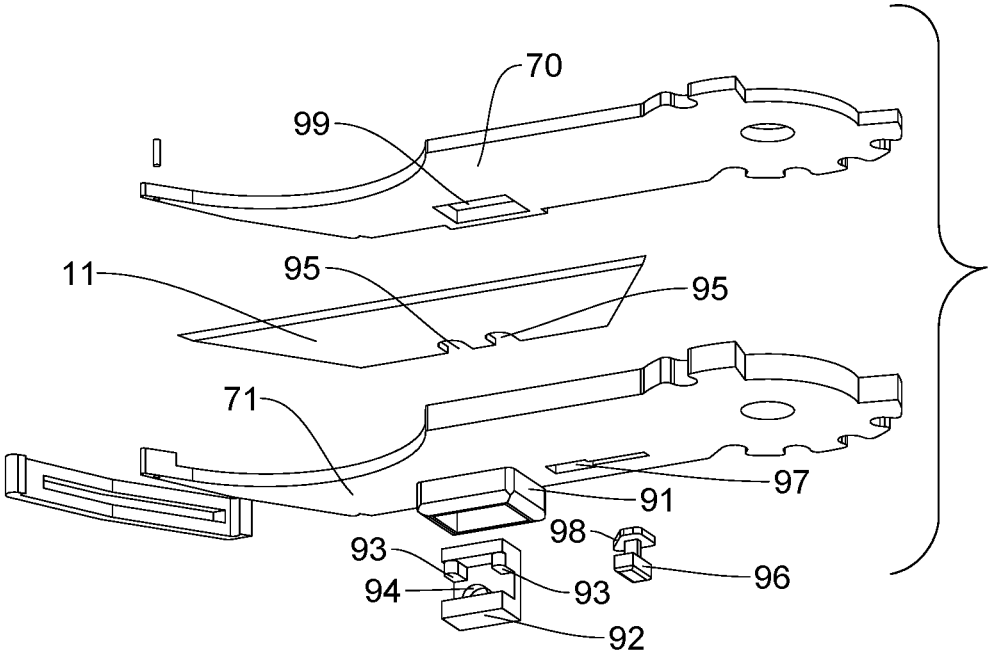
FIG. 8 is an alternate exploded perspective view of the utility blade/point protected blade holder.
Figure 9:
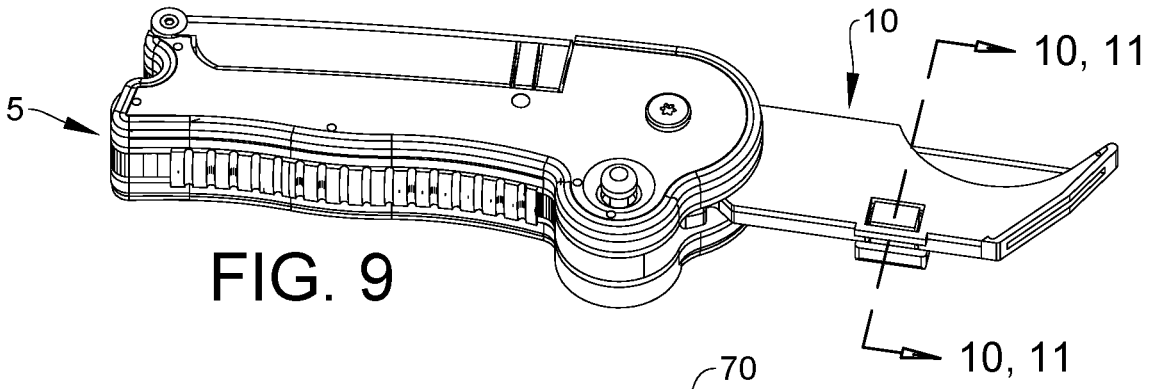
FIG. 9 is a perspective view of utility blade/point protected cutting tool defining sections 10 and 11.

Referring to FIGS. 7 and 8: a utility blade ejector (96) serves to drive the blade out of the blade holder when required for blade change thus diminishing injury risk to the user. It is inserted into the wide portion of an opening (97) provided in the recessed second part (71) at a 90-degree angle during manufacture and before blade holder assembly. Once inserted and rotated 90 degrees to its normal position and the blade holder portions are joined, it is restrained from movement other than linearly along its track to exert force on the blade side to partially eject it for replacement. The utility blade ejector portion that contacts the blade side (98) is shaped as a trapezoid to ensure maximum contact with the blade and provide linear blade movement.

Referring to FIGS. 3 and 6: with the blade holder in the retracted position, the blade restraint and the blade ejector mechanisms both interfere with some handle body second portion layers (23, 24) and as such those layers must be modified with recesses. The blade restraint is harmonized with the layer portions by adding recesses (84) and the blade ejector is harmonized by adding recesses (85). Forming these blade restraint and ejector as smaller elements would obviate the need for these recesses.

Figure 12:
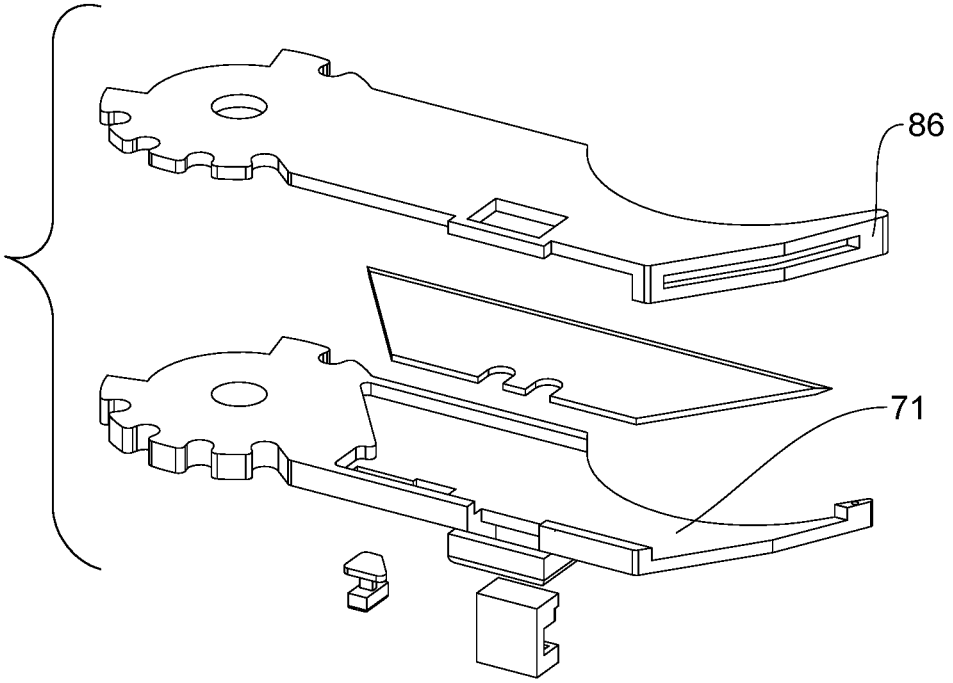
FIG. 12 is an exploded perspective view of the utility blade/point protected blade holder embodiment 2.
Figure 13:
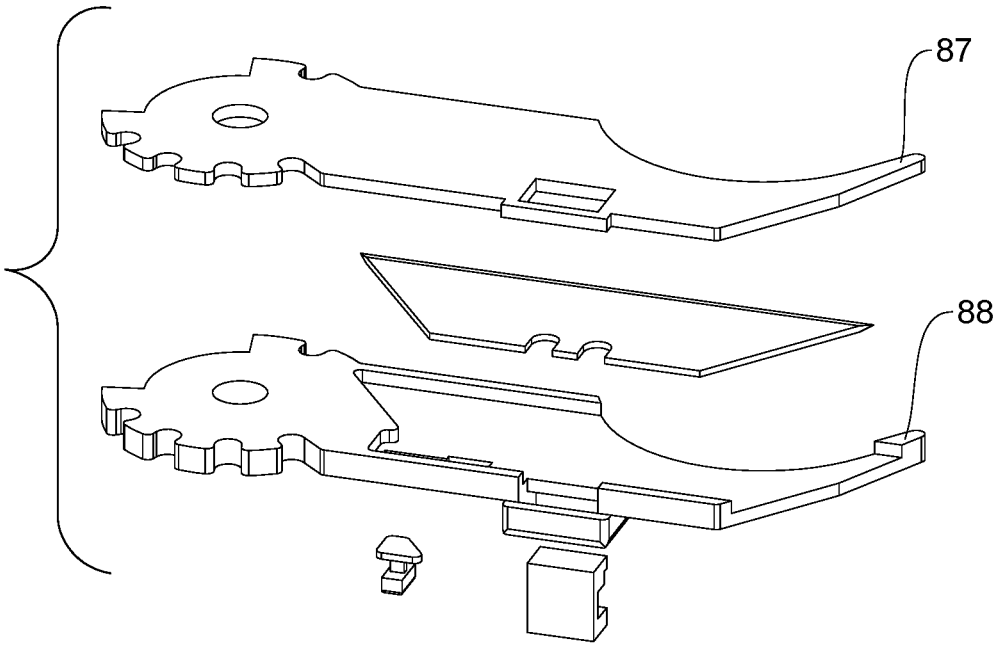
FIG. 13 is an exploded perspective view of the utility blade/point protected blade holder embodiment 3.

Referring to FIGS. 12 and 13: alternative embodiments of the utility blade/point protected blade holder assembly are disclosed with only modifications referenced in the figures. FIG. 12 shows the blade holder reinforcing piece (73) previously presented in FIG. 3 is now formed integrally with the generally utility point protected substantially planar first part to form one piece (86) which will be further joined to the previously presented utility point protected recessed second part (71). FIG. 13 shows the utility point protected blade holder first and second parts (87, 88) formed with increased proportion at the distal end of the blade holder producing a stronger nosing and eliminating the need for a nosing reinforcement piece.

Figure 14:
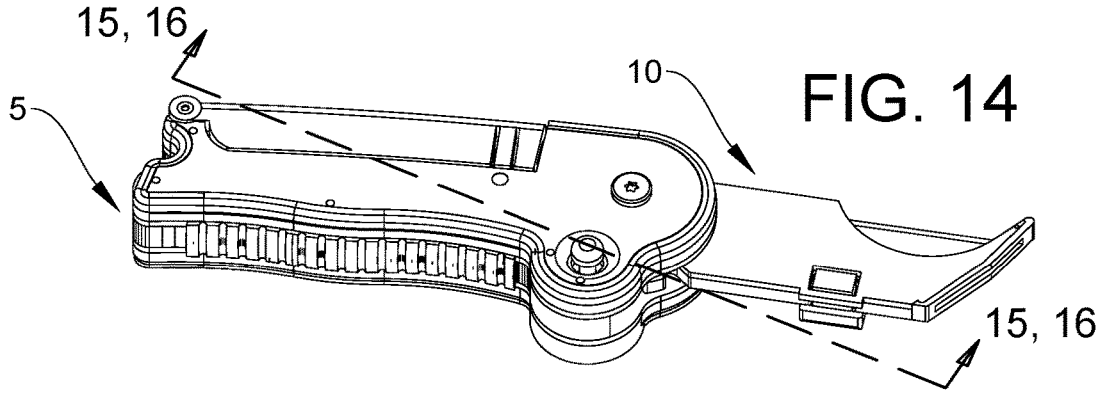
FIG. 14 is a perspective view of utility blade/point protected cutting tool defining sections 15 and 16.
Figure 15:
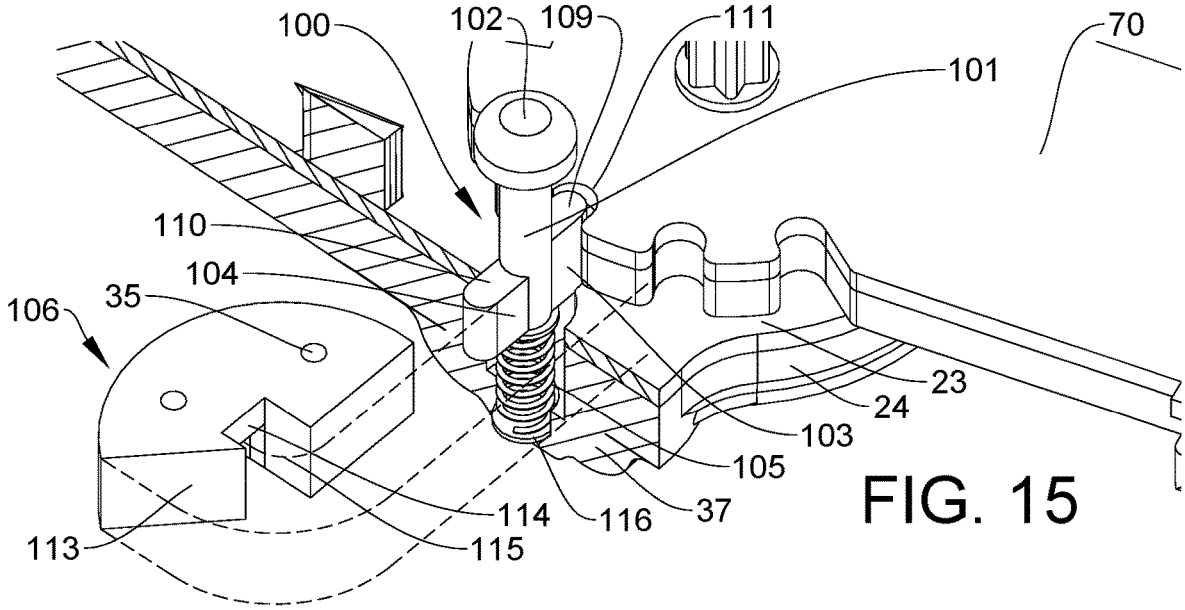
FIG. 15 is a fragmental sectional perspective view of utility blade/point protected cutting tool blade holder rotation control assembly in the locked position; pinning component restraint is displaced and rotated for visual clarity.
Figure 16:
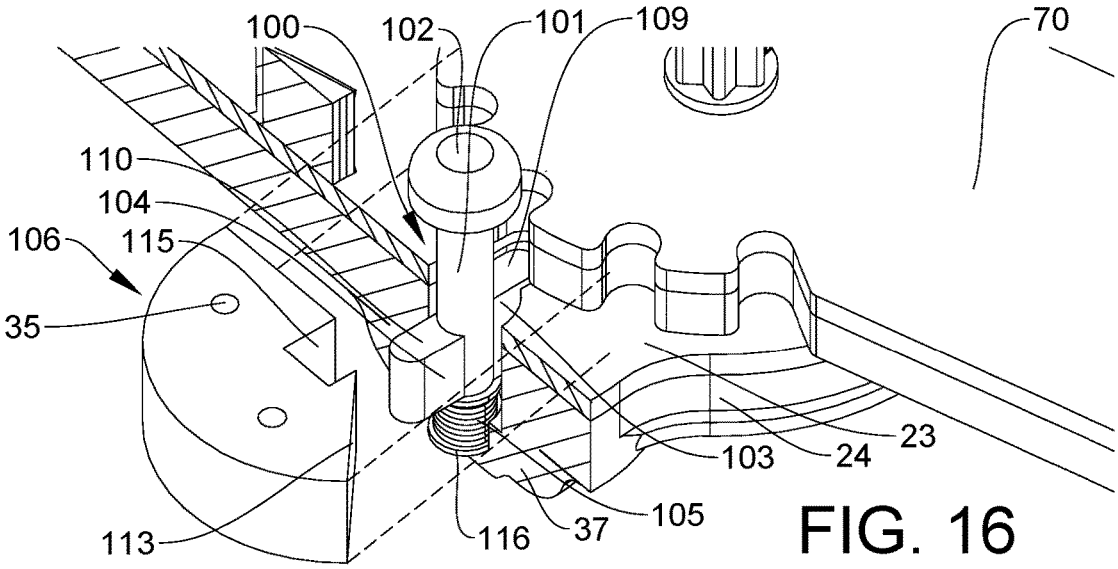
FIG. 16 is a fragmental sectional perspective view of utility blade/point protected cutting tool blade holder rotation control assembly in the unlocked position; pinning component restraint is displaced for visual clarity.
Figure 17:
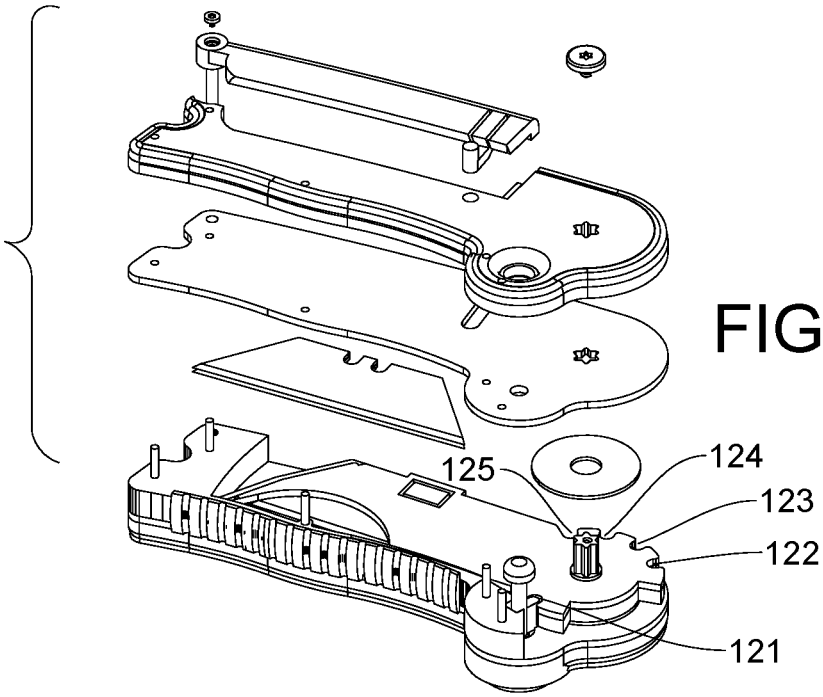
FIG. 17 is a perspective view of utility blade/point protected cutting tool with blade holder in the retracted position with some portions exploded.
Figure 18:
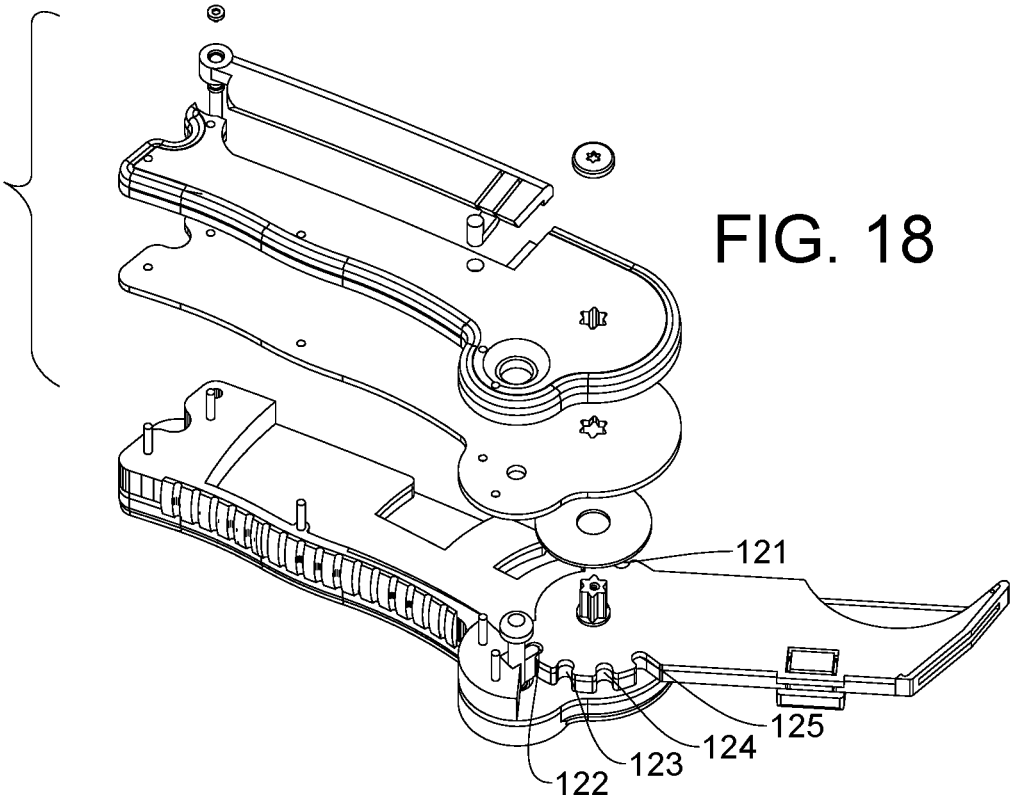
FIG. 18 is a perspective view of utility blade/point protected cutting tool with blade holder in the up position with some portions exploded.
Figure 19:
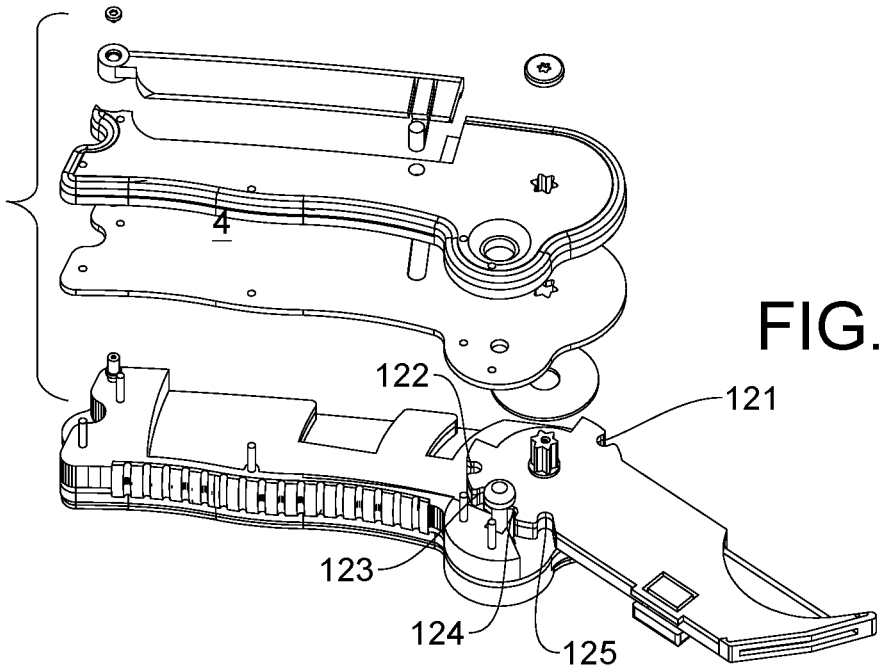
FIG. 19 is a perspective view of utility blade/point protected cutting tool with blade holder in the down 1 position with portions exploded.
Figure 20:
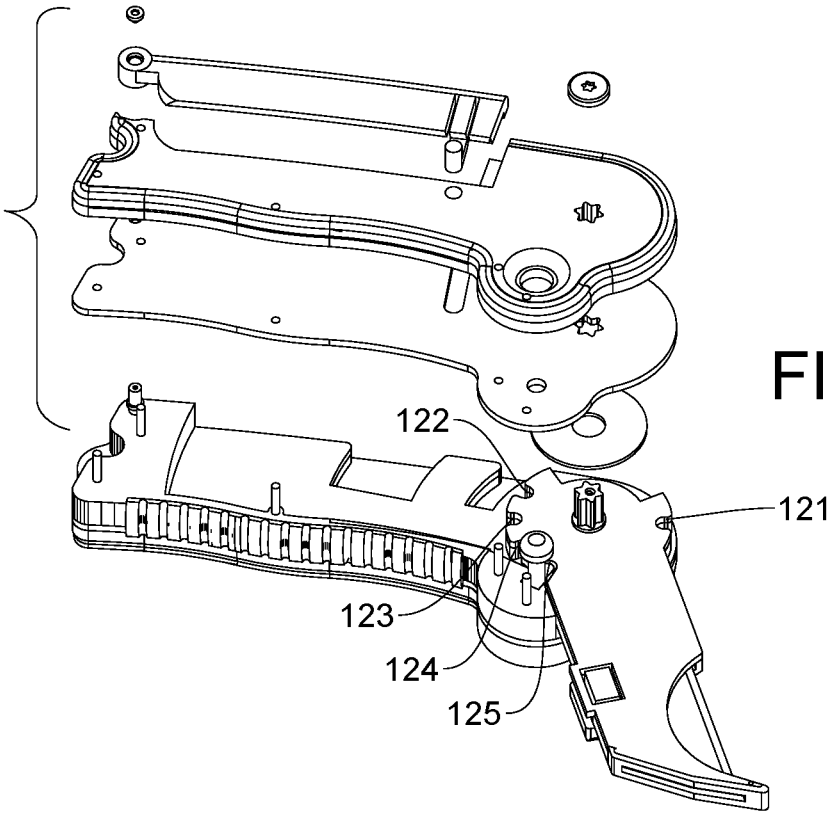
FIG. 20 is a perspective view of utility blade/point protected cutting tool with blade holder in the down 2 position with some portions exploded.

Referring to FIGS. 14-16: the blade holder rotation control assembly is presented. The rotation control assembly is essentially the same assembly for all presented cutting tool embodiments; the rotation control assembly is presented using the utility point protected cutting tool as representative of all presented cutting tool embodiments.

The blade holder rotation assembly is comprised a pinning component (100) with connected push button (102), a spring element (105), a pinning component restraint (106) and a plurality of detents along the periphery of the blade holder most proximate to the pinning component. Depressing the push button actuates the mechanism permitting the blade holder to rotate about the axis of the axially aligned coupling. Note that in FIG. 15 the pinning component restraint (106) is displaced and rotated and in FIG. 16 it is displaced—both to provide visual clarity. Rotation control assembly elements are not sectioned in either FIG. 15 or 16 to better describe their operation.

The pinning component (100) is comprised of a substantially cylindrical portion (101) with integrally connected portions (103, 104) having a form of, as a non-limiting example, a substantially rectangular elements with ovalized shape away from the cylindrical portion. The first connected portion (103) interfaces with the blade holder parts. This portion (103) is connected to the cylindrical portion (101) so that its flat side (109) generally aligns with the adjacent blade holder planar first part side (111) when the button is not actuated as shown FIG. 15. This is the locked position. When the push button (102) is depressed, the spring (105) is compressed and the entire pinning element (100) is displaced along its longitudinal axis so that the cylindrical flat portion (109) now aligns with the adjacent handle body second portion planar inner layer (23). The pinning component is now not engaged with the blade holder detent thus permitting the blade holder to rotate freely as shown in FIG. 16. Opposite to the first connected portion (103) is a second connected portion (104) which is similar in form but differs in that its placement along the generally cylindrical portion (101) is altered to permit interfacing with the pinning component restraint (106). The pinning component restraint constrains the pinning component resisting both rotational and linear forces applied to the pinning component by the blade holder during tool use. The pinning component restraint (106) is formed as a cylinder segment flattened on two sides, one of which—side (113)—serves to limit blade holder assembly travel in the unlocked position. The pinning component restraint (106) has a substantially rectangular recess formed to accommodate the pinning component second connected portion (104) and a projection (114) at this recess to constrain and limit the pinning component travel along its longitudinal axis. The pinning component restraint has openings (35) to permit conjoining to the handle body portions using the previously discussed cylindrical pins (30).

The pinning component (100) is held at its proper alignment by a helical compression spring (105) and which may have a generally flat cylindrical element (116) connected at either end to provide strength and stability to the spring operation. Other force resisting devices may be used in place of the spring. As shown in FIGS. 3, 6, 15, and 16, a recess in and projection (37) from the first half layer portion (24) forms a housing for the spring and accompanying flat cylindrical elements.

Referring to FIGS. 17-20: the rotational functioning of the utility blade holder and rotational control assembly is further described using the point/protected tool as representative of both utility type blade holders. Please note some portions are exploded as indicated by brackets to more clearly show the blade holder/rotational control assembly interface. As previously described the blade holder substantially planar first part and recessed second part both have a plurality of detents which serve to engage the pinning component first portion and thus the entire rotation control assembly. In the presented embodiment, the blade holder has five positions and a detent for each as a non-limiting example of possible configurations. The tool positions are shown as: retracted, FIG. 17; up position, FIG. 18; down position 1, FIG. 19; down position 2, FIG. 19; fully extended, FIGS. 1-6. The positions followed by their specific detent reference numbers are given here: retracted (121), up position (122), fully extended (123), down position 1 (124) and down position 2 (125). The varied positions afford the user the ability to make cutting motions at a variety of angles with relation to the plane of the materials to be cut. Both the number and angular positioning of the detents can be optionally modified.

Figure 21:
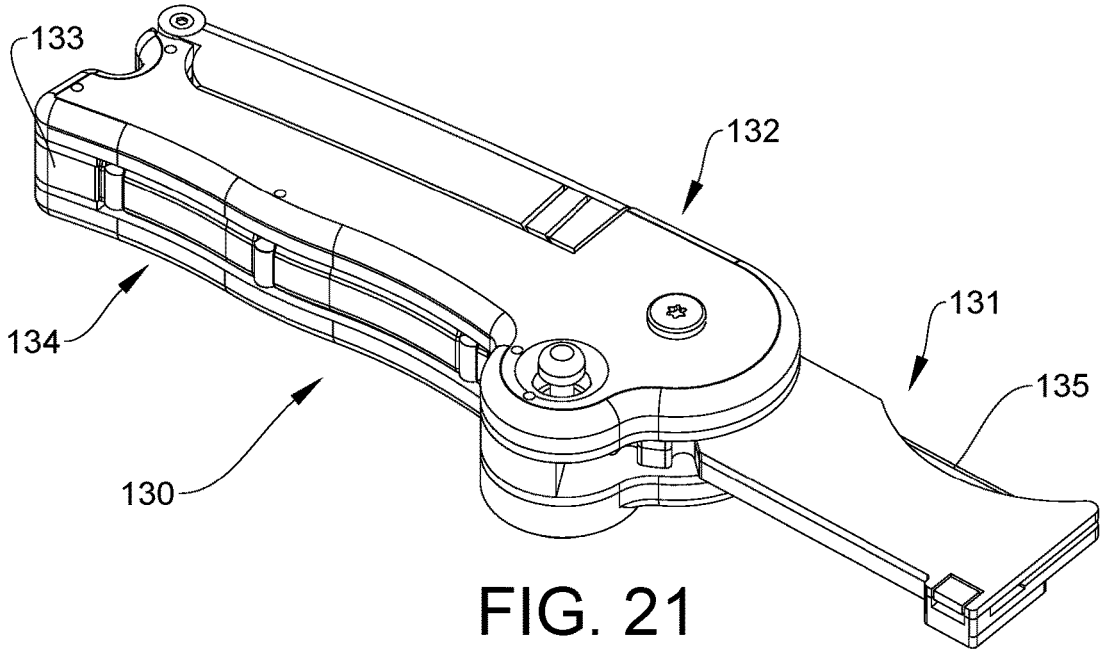
FIG. 21 is a perspective view of the razor blade/point protected cutting tool.
Figure 22:
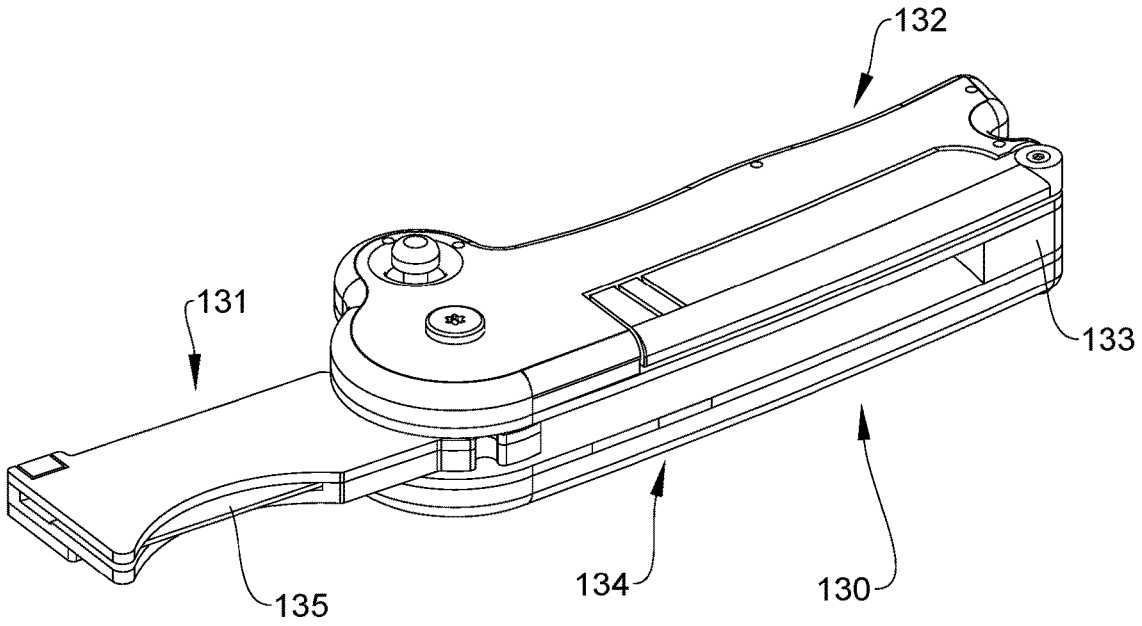
FIG. 22 is an alternate perspective view of the razor blade/point protected cutting tool.
Figure 23:
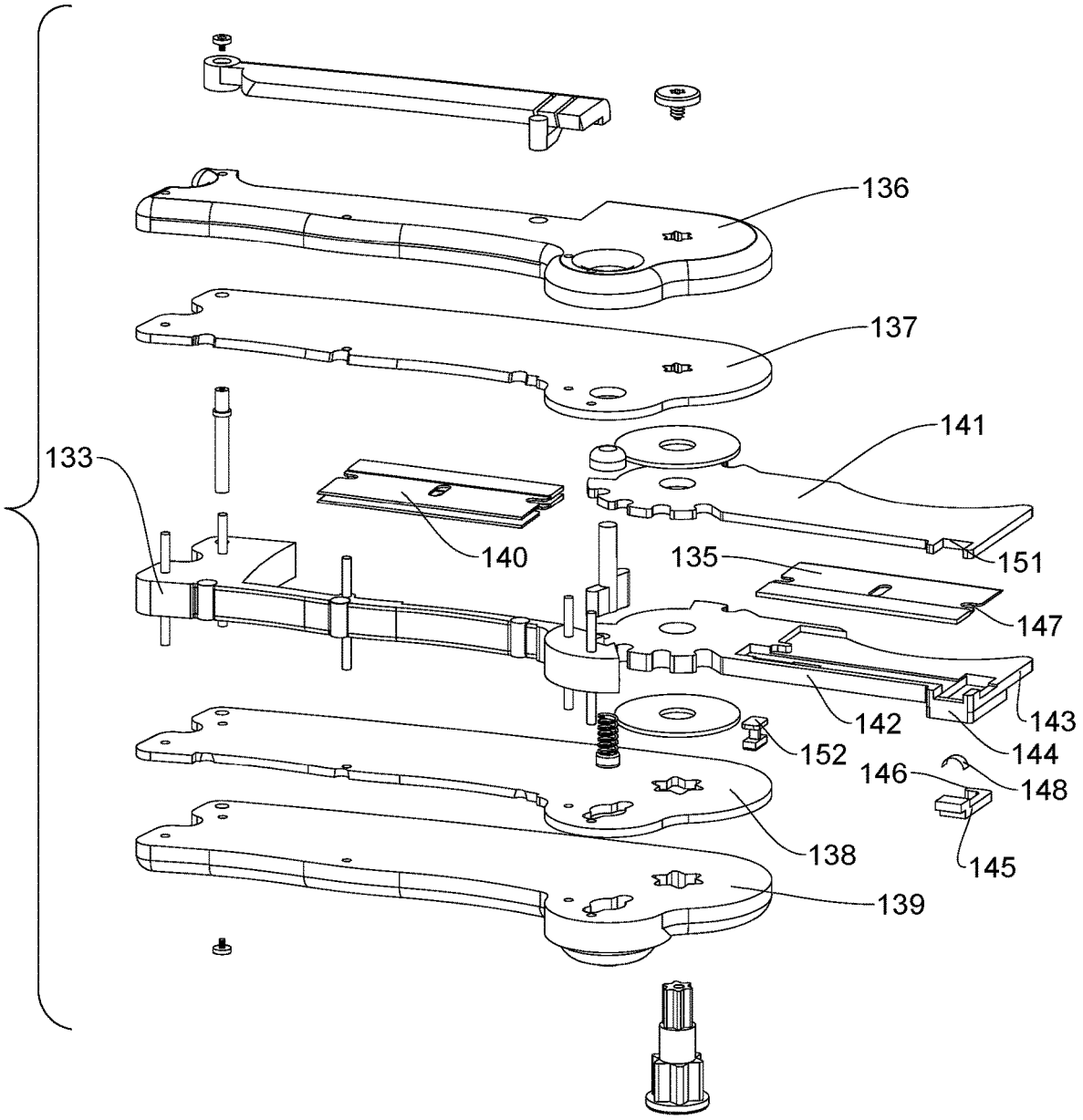
FIG. 23 is an exploded perspective view of the razor blade/point protected cutting tool.

Referring to FIGS. 21-23: the razor blade/point protected embodiment cutting tool presented is comprised of a razor handle body (130) and a razor blade holder assembly (131). The razor handle body is further comprised of a razor body first half portion (132), razor body center portion (133) and razor body second half portion (134) which are placed together to form a razor handle body to house and deploy a razor blade/point protected blade holder (131) and standard single edge razor blade (135). The razor body first half portion (132), body center portion (133) and body second half portion constituents (134) are presented with ornamentally different filleting and the ribbed elements of the center portion removed to illustrate an embodiment of a tool which for some may be more comfortable to hold. The razor blade/point protected cutting tool blade holder rotation control assembly is formed and functions as that of the utility blade cutting tools. Additionally, the fasteners, couplings and spare blade compartment cover are also as with the utility blade tools. Therefore, these aspects of the razor blade tool will not be repeated and only differences from the utility blade tools will be described. The razor blade tool handle body portions and their constituent layer elements have been given different reference numbers to differentiate them from those of the utility blade tool handle body. As shown in FIG. 23, the various body layer elements have been given reference numbers (136) through (139), again, to distinguish the layers from those of the utility tool. The spare blade compartment now stores two spare flat edge razor blades (140). The razor blade/point protected blade holder also optionally comprises a reinforcing piece with crescent shaped ends to enclose portions of the blade holder first and second parts and thus stiffen the entire assembly. In addition, this reinforcing piece serves to further define the shape of the nosing and isolate the razor blade point from materials to be cut. The reinforcing piece possesses a center opening substantially aligning with that of the recessed second part to allow blade extraction. As this razor blade holder reinforcing piece is similar to that of the utility blade holder, it is not shown or referenced here.

The razor blade holder, the razor blade restraint and razor blade ejector for the razor tool are different from those of the utility blade tools and are disclosed here. Referring to FIG. 23: the razor blade/point protected blade holder assembly is comprised of a substantially-planar first part (141) and a recessed second part (142) which possesses a recess in the approximate shape of a standard rectangular single edge razor blade. As with the utility tool, the depth of this recess should be selected so as to prohibit excessive movement of the razor blade orthogonal to its thin dimension. The recessed second part recess is open on the distal side of the blade holder and partially open adjacent to the razor blade cutting edge (143). When both razor blade holder parts are joined, the blade holder constrains the blade except as to allow movement (extraction) linearly towards where the recessed second part recess is open (143). As previously described, this blade holder design permits, when used blade edge up and with motion generally away from the user, cutting planar materials without damaging materials not intended to be cut by virtue of isolating the materials to be cut from the point of the blade.

Referring to FIG. 23-26: the razor blade restraint is comprised of a recess and housing portion (144) at the distal side of the razor blade holder, a razor blade engagement piece (145) with a single projection (146) which engages the razor blade detent (147) preventing blade movement when the mechanism is in the unactuated position as shown in FIG. 25. A circular leaf type spring (148) provides a resistive force in this position and the razor blade holder parts (141, 142), when joined, constrain the blade restraint in place. When a force is applied to the substantially-planar first part side of the razor blade engagement piece (145), the spring compresses, its ends move outward from the center and the restraint piece projection (146) retracts aligning the flat portion with the inner surface of the blade holder recessed second part permitting the blade to be extracted as shown in FIG. 26. Both the recessed second part housing (144) and a recess (151) in the substantially-planar first part of the blade holder work to constrain the blade engagement piece so that it moves only in the direction of spring compression and limits its amount of travel. Also, the portion of the blade holder recessed second part (142) that makes contact with the spring is curved (149) as shown in the sectioned area of FIGS. 25 and 26 to provide increased spring stability. Note the planar first part (141) is displaced and both the blade holder parts (141, 142) and blade engagement piece are sectioned in FIGS. 25 and 26 to provide visual clarity.

A razor blade ejector (152) serves to drive the blade out of the blade holder when required for blade change thus diminishing injury risk to the user. It is inserted into the wide portion of an opening provided in the recessed blade recessed layer element at a 90-degree angle during manufacture and before blade holder assembly. The razor blade ejector portion that contacts the blade side is shaped as a rectangle to ensure maximum contact with the blade and to provide linear blade movement. Once inserted and rotated 90 degrees to its normal position and the blade holder parts are joined, it is restrained from movement other than linearly along its track to exert force on the blade proximal side to partially eject it for replacement. The razor blade restraint and the razor blade ejector of the razor blade holder assembly can be made of proportions to eliminate the interference with the razor handle body second portion layers (138) and (139). Thus, as shown in FIG. 23 the recesses in those layers (138, 139) associated with interference have been eliminated.

Figure 27:
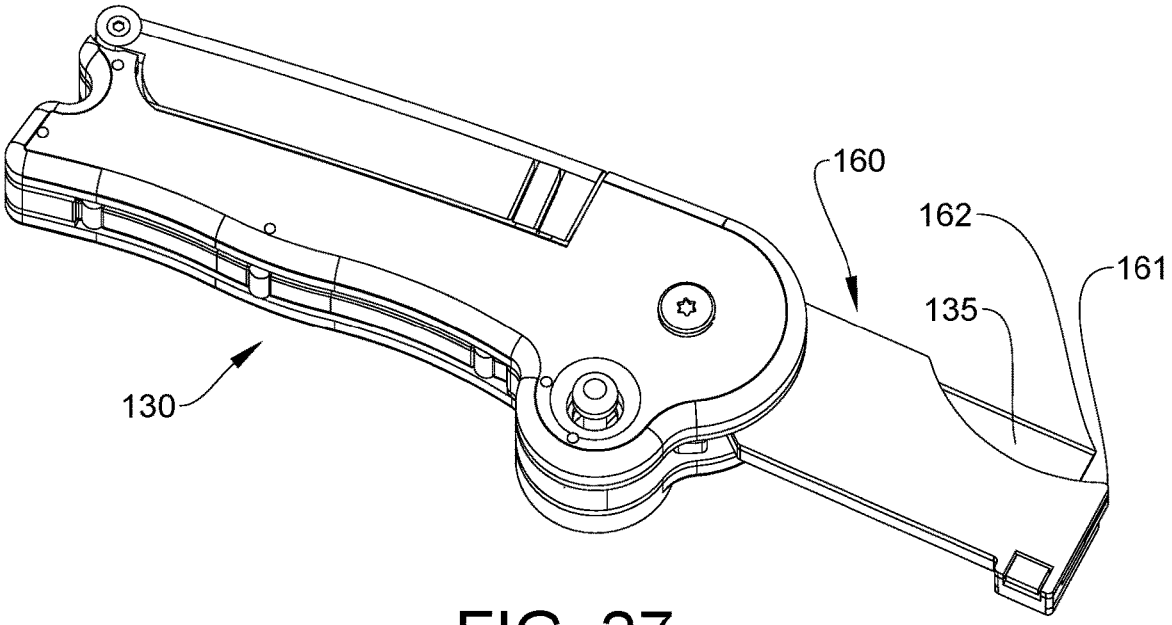
FIG. 27 is a perspective view of the razor blade/point open cutting tool.
Figure 28:
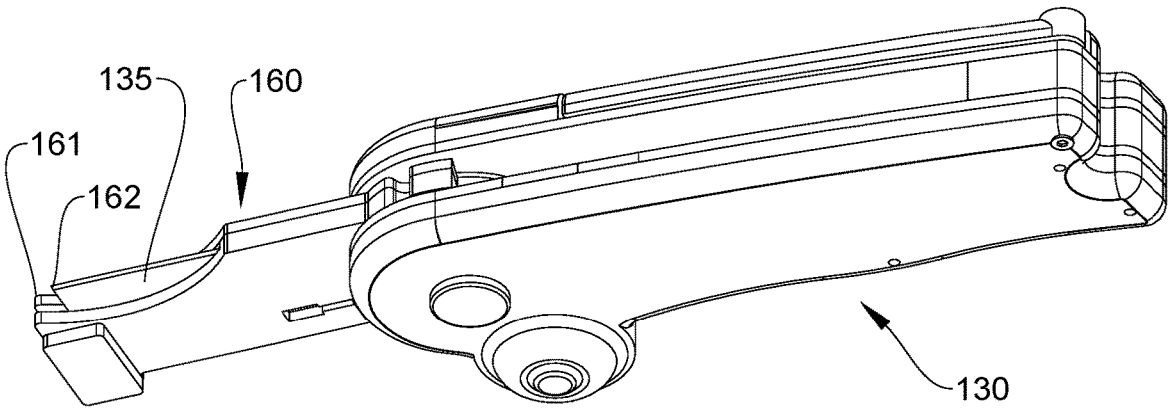
FIG. 28 is an alternate perspective view of the razor blade/point open cutting tool.

Referring to FIGS. 27 and 28: the razor blade/point open embodiment cutting tool presented comprises a razor handle body (130) and a razor blade/point open blade holder (160). The handle body, use of fasteners and couplings, blade holder rotation control assembly, razor blade restraint and razor blade ejector are as with the razor blade/point protected embodiment cutting tool and their description will not be repeated. The razor blade/point open blade holder (160) differs from the point protected in that the blade holder portion (161) closest to the blade point is modified exposing a non-cutting edge portion (162) of the razor blade (135). This feature allows for the user to cut as with the point protected tool previously described and, additionally, blade down with the point of the tool. Again, proper cutting blade edge up/away from the user requires establishing a blade angle relative to the material be to be cut so as to ensure that the blade holder nosing and not the blade contacts the surface underneath the material to be cut.

Figure 29:
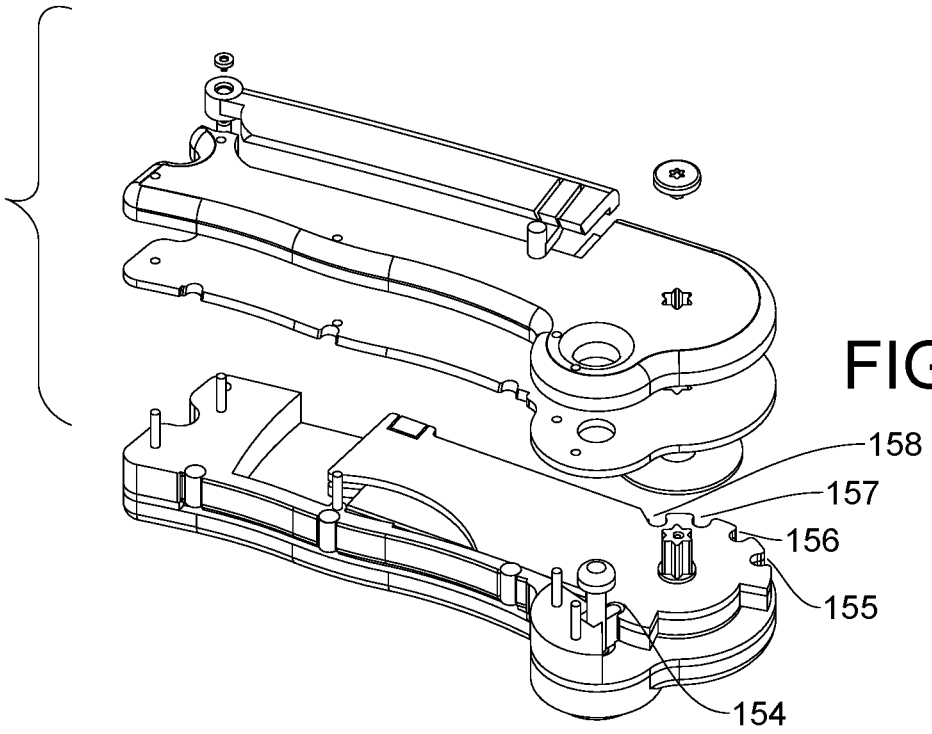
FIG. 29 is a perspective view of razor blade/point open cutting tool with blade holder in the retracted position with some portions exploded.
Figure 30:
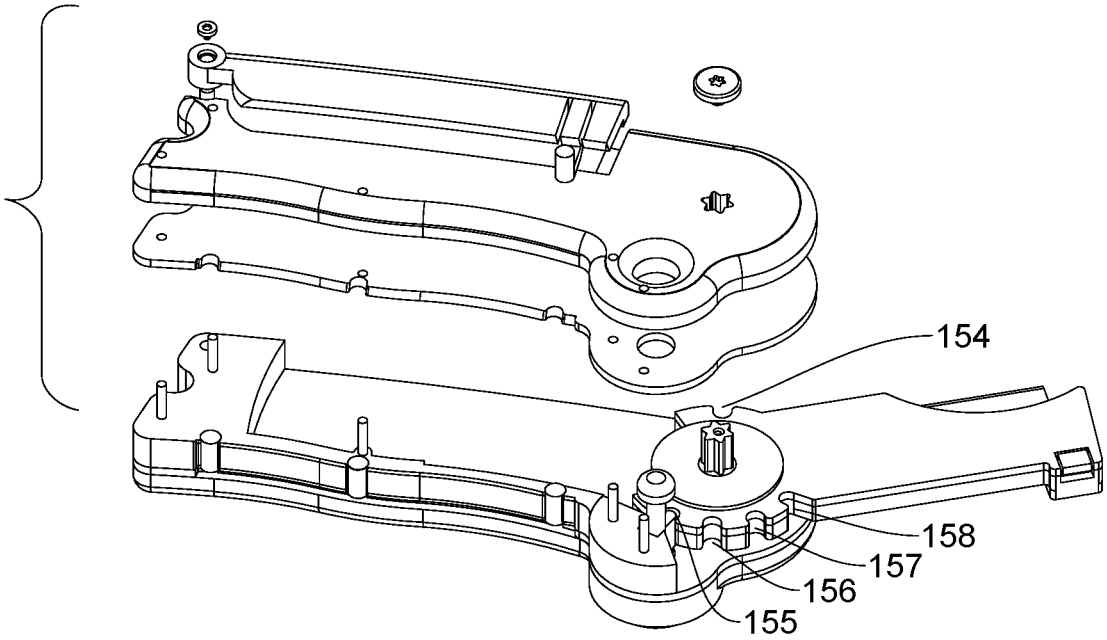
FIG. 30 is a perspective view of razor blade/point open cutting tool with blade holder in the up position with some portions exploded.
Figure 31:
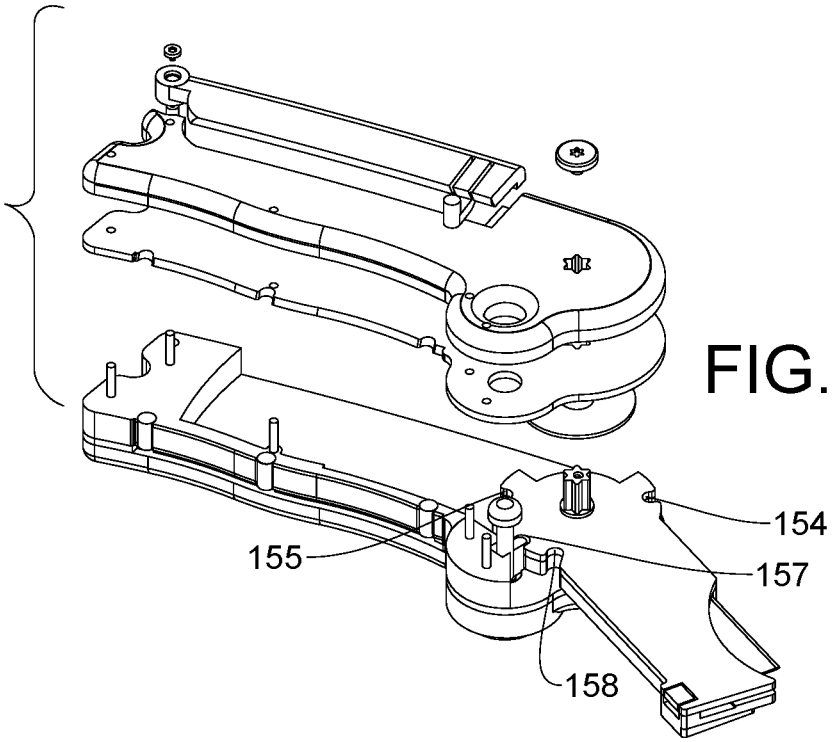
FIG. 31 is a perspective view of razor blade/point open cutting tool with blade holder in the down 1 position with some portions exploded.
Figure 32:
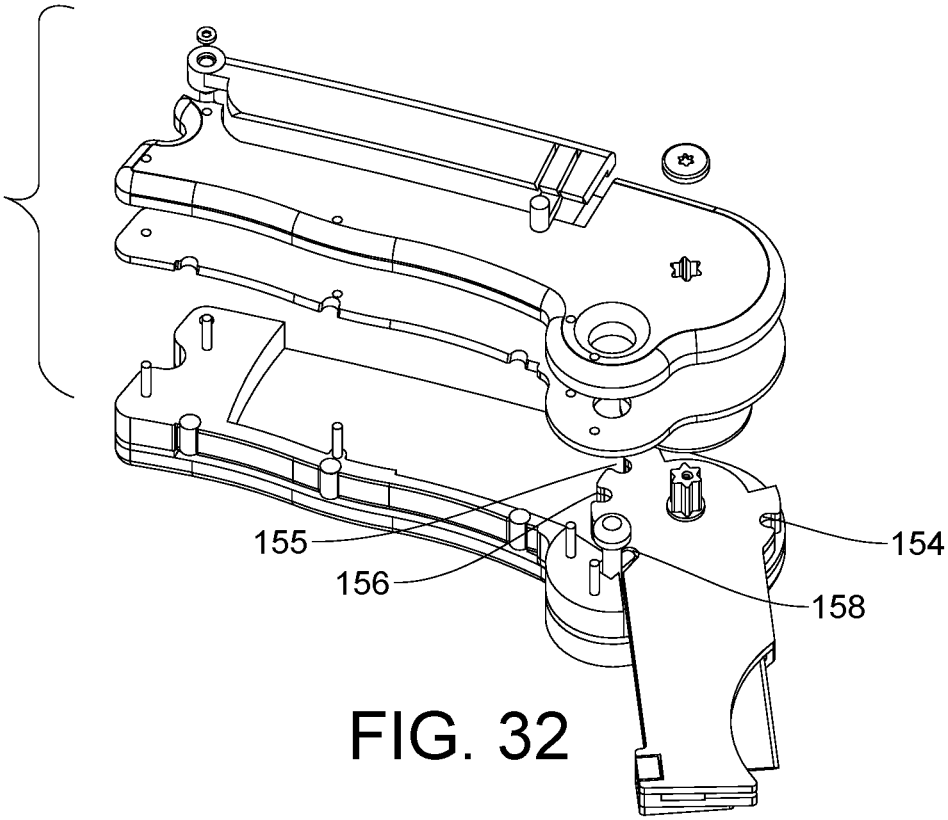
FIG. 32 is a perspective view of razor blade/point open cutting tool with blade holder in the down 2 position with some portions exploded.

Referring to FIGS. 29-31: the functioning of the razor blade/point open blade holder assembly rotation is described as representative of all razor blade cutting embodiments. Please note some parts are exploded as indicated by brackets to more clearly show the razor blade holder/blade holder control assembly interface. As previously described the blade holder substantially-planar first and recessed second parts both have a plurality of aligned detents which serve to engage the pinning component first portion and thus the entire pinning component. In the presented embodiment, the blade holder has five positions and a detent for each. The tool positions are shown as: retracted, FIG. 29; up position, FIG. 30; down position 1, FIG. 31; down position 2, FIG. 32; fully extended, FIGS. 21-23. The positions followed by their specific detent reference numbers are given here: retracted (154), up position (155), fully extended (156), down position 1 (157) and down position 2 (158). For other embodiments both the number and angular positioning of the detents can vary.

Figure 33:
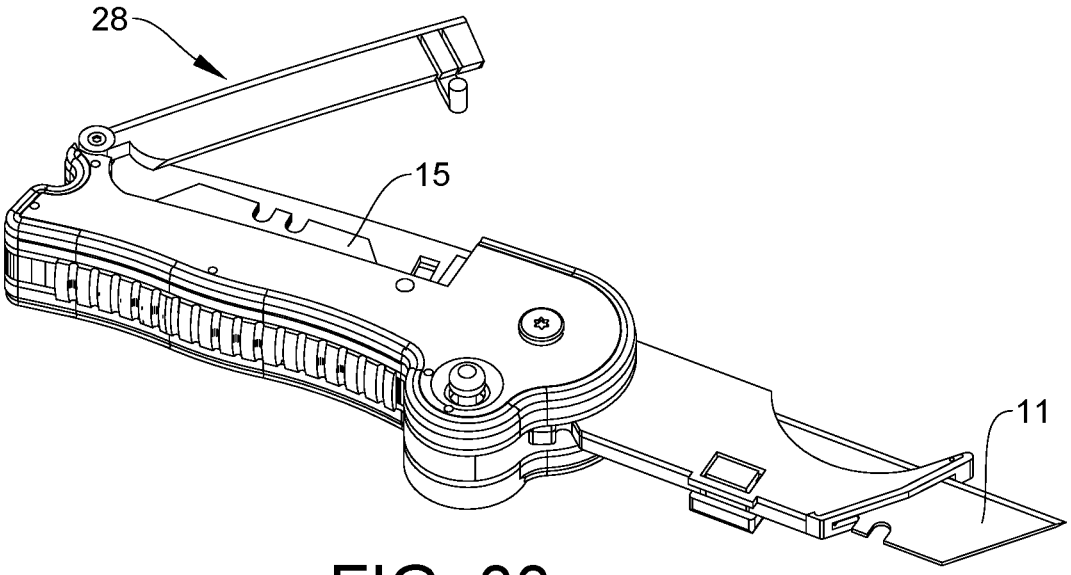
FIG. 33 is a perspective view of the utility blade/point protected cutting tool with spare blade compartment cover partially open and utility blade partially removed.
Figure 34:
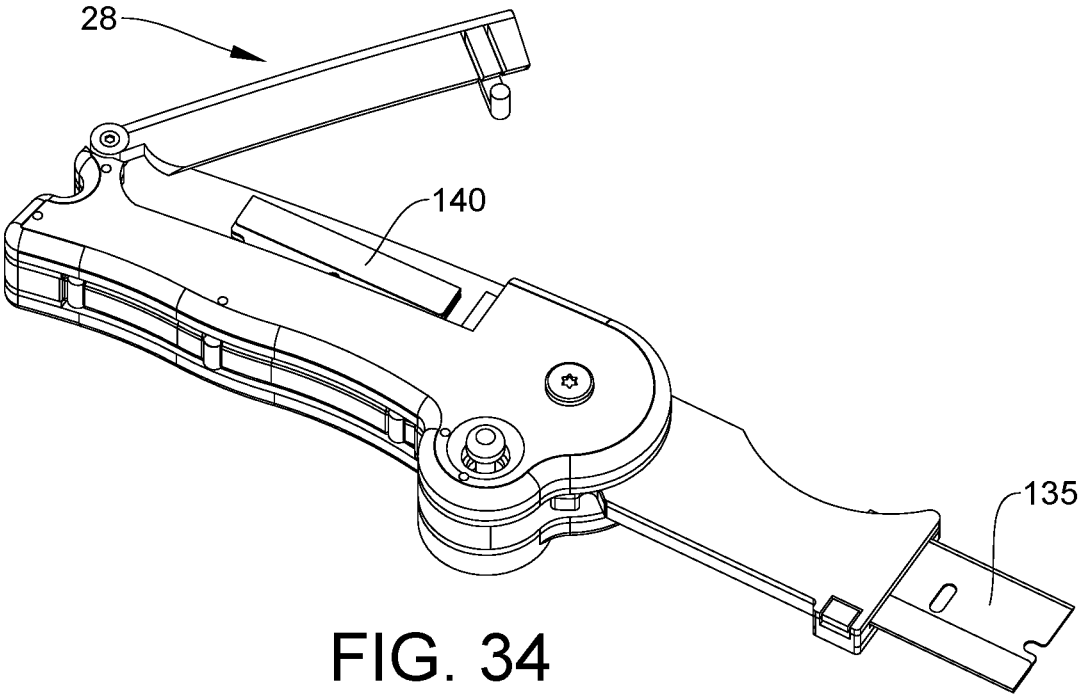
FIG. 34 is a perspective view of the razor blade/point protected cutting tool with spare blade compartment cover partially open and razor blade partially removed.

Referring to FIGS. 33-34: the previously described utility blade/point protected embodiment cutting tool FIG. 33 and the razor blade/point protected embodiment cutting tool FIG. 34 are shown with the spare blade compartment cover (28) partially open, their respective types of spare blades (15, 140) visible and the respective blades (11, 135) partially ejected from their blade holders.

In all embodiments, the blade holder's nosing and the constituent parts that form them may be altered in shape and form so as to provide a cutting angle—the angle between the particular blade and the cutting plane of the object being cut—more capable of facilitating tool forward motion while isolating the blade.

Description of Materials of Fabrication Presented as Non-Limiting Examples:

For the more complex layer elements of the handle body such as the contoured outer layers, materials for fabrication may be relatively high strength plastics such as polypropelene and ABS. For those tool elements requiring higher fracture resistance, thermoplastic elastomers may be used and for color fastness of outer layers, polyoxymethylene. These same material considerations apply to the blade holder recessed parts and blade holder rotation control assembly pinning component restraint element.

For elements possessing simpler, more planar shapes and requiring more rigidity and fracture resistance such as the inner layers of the handle body and the generally planar first part of both blade holder types, metals may be appropriate. Die cast metals such as zinc aluminum alloys may also be appropriate for tool elements requiring greater strength and flexural resistance. Stamping, including combining operations of blanking and punching may be appropriate for these as well as the blade holder flat layer element.

Blade holder rotation control assembly pinning component, connected push button, blade restraints and blade ejectors can be manufactured by casting appropriate yield and tensile strength steel including but not limited to grade five or, if higher strength is required, by casting or machining metal with higher yield and tensile strength steel such as grade eight steel.

Figure 35:
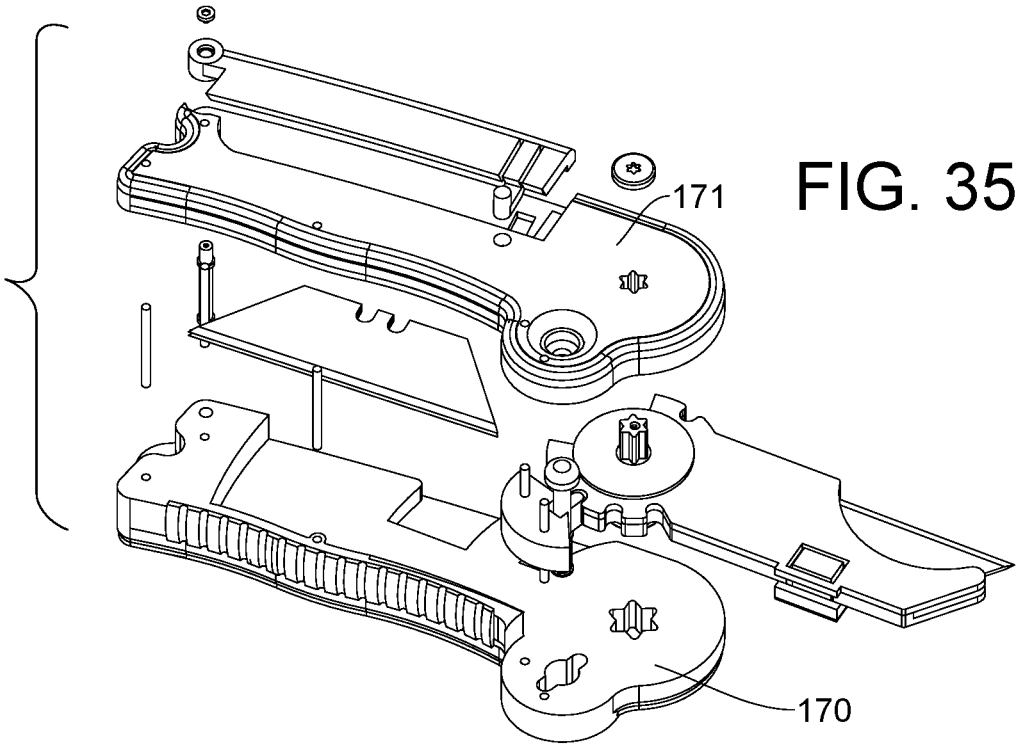
FIG. 35 is a perspective view of the utility blade/point open cutting tool with body layers consolidated.

Referring to FIG. 35: the utility blade/point open embodiment cutting tool is shown as a simpler to manufacture embodiment possessing the characteristics of the invention. The utility handle body first half portion and its constituent layers are fabricated as one integral utility first body component (171). The utility handle body second half portion and its constituent layers and the utility body center portion are formed as one integral utility second body component (170).

Figure 36:
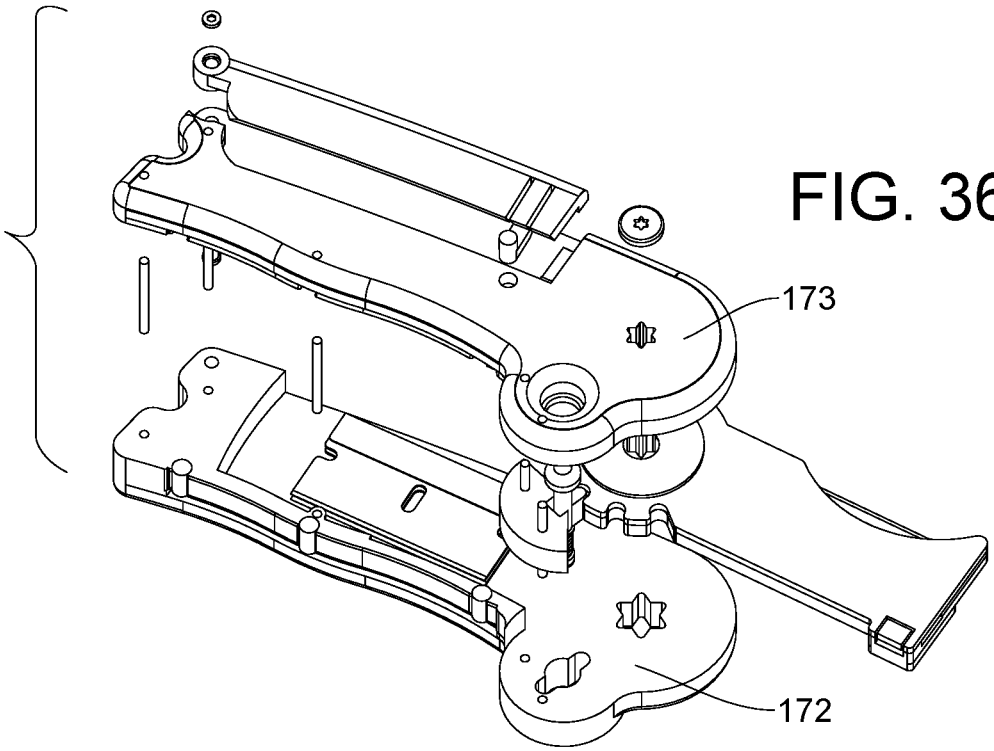
FIG. 36 is a perspective view of the razor blade/point protected cutting tool with body layers consolidated.

Likewise referring to FIG. 36: The razor blade/point protected cutting tool is presented with the razor handle body first half portion and its constituent layers are formed as one integral razor first component (173). The razor handle body second first half portion and its constituent layers and the razor body center portion are formed as one integral razor second component (172). For both embodiments, typically higher strength plastics including but not limited to fiber reinforced plastics, PPS (polyphenylene) or polyamideimide (PAI) using single shot or other molding techniques may be used, again as non-limiting examples, to provide requisite rigidity, strength and durability. Regardless of the selected material, the general proportional and shape constraints between portions of the tool elements apply.

What is claimed is:

1. A handheld cutting tool, comprising:

a handle body;

a utility blade holder comprising:

a utility substantially-planar first part;

a utility recessed second part possessing a recess, said recess shaped substantially in the form of a replaceable isosceles trapezoid utility blade, said recess having an opening adjacent a utility blade cutting edge and said recess having an opening at a distal end of the utility recessed second part;

an arced portion at a proximal end of the utility substantially-planar first part and an arced portion at a proximal end of the utility recessed second part, both said arced portions possessing a plurality of detents along their periphery;

a cylindrical opening in both the utility substantially-planar first part and the utility recessed second part, both the openings formed to receive a coupling, said coupling pivotally connecting the utility blade holder to the handle body and said coupling serving as a pivot point for utility blade holder rotational motion; and a portion formed by a distal end of the utility substantially-planar first part and by the distal end of the utility recessed second part, both said portions formed so as to isolate portions of the utility blade from objects not intended to be cut;

and a utility tool rotation control assembly comprising:

a pinning component further comprising:

a cylindrical center portion;

a projecting first portion capable of being operably engaged to both the utility blade holder substantially-planar first part detent and the utility recessed second part detent most proximate to the pinning component projecting first portion in any of a plurality of utility blade holder rotational positions; and a projecting second portion;

a pinning component restraint piece, said restraint piece capable of being operably engaged to the pinning component projecting second portion so as to restrict pinning component rotational motion about a pinning component longitudinal axis; and a push button operably connected to the pinning component whose actuation provides movement of the pinning component along the pinning component longitudinal axis so as to operably disengage the pinning component projecting first portion from both the utility blade holder substantially-planar first part detent and the utility recessed second part detent most proximate to the pinning component thus permitting utility blade holder rotational motion.

2. A handheld cutting tool, comprising:

a handle body;

a razor blade holder comprising:

a razor substantially-planar first part;

a razor recessed second part possessing a recess, said recess shaped substantially in the form of a replaceable single edge razor blade, said recess having an opening adjacent a razor blade cutting edge and said recess having an opening at a distal end of the razor recessed second part;

an arced portion at a proximal end of the razor substantially-planar first part and an arced portion at a proximal end of the razor recessed second part, both said arced portions possessing a plurality of detents along their periphery;

a cylindrical opening in both the razor substantially-planar first part and the razor recessed second part, both the openings formed to receive a coupling, said coupling pivotally connecting the razor blade holder to the handle body and said coupling serving as a pivot point for razor blade holder rotational motion; and a portion formed by a distal end of the razor substantially-planar first part and by the distal end of the razor recessed second part, both said portions formed so as to isolate portions of the razor blade from objects not intended to be cut;

and a razor tool rotation control assembly comprising:

a pinning component further comprising:

a cylindrical center portion;

a projecting first portion capable of being operably engaged to both the razor blade holder substantially-planar first part detent and the razor recessed second part detent most proximate to the pinning component projecting first portion in any of a plurality of razor blade holder rotational positions; and a projecting second portion;

a pinning component restraint piece, said restraint piece capable of being operably engaged to the pinning component projecting second portion so as to restrict pinning component rotational motion about a pinning component longitudinal axis; and a push button operably connected to the pinning component whose actuation provides movement of the pinning component along the pinning component longitudinal axis so as to operably disengage the pinning component projecting first portion from both the razor blade holder substantially-planar first part detent and the razor recessed second part detent most proximate to the pinning component thus permitting razor blade holder rotational motion.

3. The handheld cutting tool of claim 1, wherein the utility blade holder further comprises a utility blade restraint operably coupled to the utility blade holder for constraining or, alternately, releasing a replaceable utility blade without tool disassembly;

the utility blade restraint further comprising;

a housing formed with the utility blade holder;

a utility blade engagement block; and a spring.

4. The handheld cutting tool of claim 2, wherein the razor blade holder further comprises a razor blade restraint operably coupled to the razor blade holder for constraining or, alternately, releasing a replaceable razor blade without tool disassembly;

the razor blade restraint further comprising;

a housing formed with the razor blade holder;

a razor blade engagement piece; and a spring.

5. The handheld cutting tool of claim 1, wherein the utility blade holder further comprises an opening in the utility recessed second part and a utility blade ejector placed in said opening to assist in ejecting a replaceable utility blade.

6. The handheld cutting tool of claim 2, wherein the razor blade holder further comprises an opening in the razor recessed second part and a razor blade ejector placed in said opening to assist in ejecting a replaceable razor blade.

7. The handheld cutting tool of claim 1, the handle body comprising:

a utility body first half portion having a utility contoured outer layer and a utility substantially-planar inner layer;

a utility body second half portion having a utility contoured outer layer and a utility substantially-planar inner layer; and a utility body center portion being disposed between the utility body first half portion and the utility body second half portion, said utility first half, utility second half and utility center portions arranged, configured and joined to create a body structure for a utility blade cutting tool.

8. The handheld cutting tool of claim 2, the handle body comprising:

a razor body first half portion having a razor contoured outer layer and a razor substantially-planar inner layer;

a razor body second half portion having a razor contoured outer layer and a razor substantially-planar inner layer; and a razor body center portion being disposed between the razor body first half portion and the razor body second half portion, said razor first half, razor second half and razor center portions arranged, configured and joined to create a body structure for a razor blade cutting tool.

9. The handheld cutting tool of claim 1, the utility blade holder further comprising a utility blade holder reinforcing piece.

10. The handheld cutting tool of claim 2, the razor blade holder further comprising a razor blade holder reinforcing piece.

11. The handheld cutting tool of claim 7, the handle body comprising:

the utility body first half portion and its constituent layers formed as one utility first component; and the utility body second half portion and its constituent layers and the utility body center portion formed as one utility second component, said utility first and utility second components arranged, configured and joined to create a body structure for a utility blade cutting tool.

12. The handheld cutting tool of claim 8, the handle body comprising:

the razor body first half portion and its constituent layers formed as one razor first component; and the razor body second half portion and its constituent layers and the razor body center portion formed as one razor second component, said razor first and razor second components arranged, configured and joined to create a body structure for a razor blade cutting tool.

13. The handheld cutting tool of claim 7, wherein a plurality of utility tool handle body portions and layers are conjoined and constrained by a plurality of cylindrical fasteners adhesively bonded to said tool handle body portions and layers.

14. The handheld cutting tool of claim 8, wherein a plurality of razor tool handle body portions and layers are conjoined and constrained by a plurality of cylindrical fasteners adhesively bonded to said tool handle body portions and layers.

15. The handheld cutting tool of claim 1, further comprising portions intended to interface with and be restrained by an axially aligned coupling and possessing openings which are the negative of a polygonal shaped radially adjacent portion of the coupling.

16. The handheld cutting tool of claim 2, further comprising portions intended to interface with and be restrained by the axially aligned coupling and possessing openings which are the negative of the polygonal shaped radially adjacent portion of the coupling.

17. The handheld cutting tool of claim 1, further comprising portions intended to interface with and be permitted rotation by the axially aligned coupling and possessing openings which are the negative of a cylindrically shaped radially adjacent portion of the coupling.

18. The handheld cutting tool of claim 2, further comprising portions intended to interface with and be permitted rotation by the axially aligned coupling and possessing openings which are the negative of a cylindrically shaped radially adjacent portion of the coupling.

19. The cutting tool of claim 1, wherein the handle body includes a spare blade compartment further comprised of a spare blade compartment cover pivotally connected to the handle body by a two-sided coupling and fastener, said cover characterized by a:

a substantially planar portion;

an integrally connected orthogonal portion; and a locking mechanism.

20. The cutting tool of claim 2, wherein the handle body includes a spare blade compartment further comprised of a spare blade compartment cover pivotally connected to the handle body by a two-sided coupling and fastener, said cover characterized by a:

a substantially planar portion;

an integrally connected orthogonal portion; and a locking mechanism.

* * * * *